US008585242B2

(12) United States Patent
Walczak et al.

(10) Patent No.: US 8,585,242 B2
(45) Date of Patent: Nov. 19, 2013

(54) LIGHTING SYSTEM WITH LIGHT-EMITTING DIODES AND SECURING STRUCTURE

(75) Inventors: Steve Walczak, Kenosha, WI (US); Derek Scott Mallory, Plymouth, MI (US)

(73) Assignee: Sternberg Lanterns, Inc., Roselle, IL (US)

( * ) Notice: Subject to any disclaimer, the term of this patent is extended or adjusted under 35 U.S.C. 154(b) by 277 days.

(21) Appl. No.: 12/700,308

(22) Filed: Feb. 4, 2010

(65) Prior Publication Data

US 2011/0188241 A1 Aug. 4, 2011

(51) Int. Cl.
*F21V 21/00* (2006.01)

(52) U.S. Cl.
USPC ..... 362/249.02; 362/294; 362/311.02; 362/373

(58) Field of Classification Search
USPC ..... 362/249.02, 311.02, 293, 373
See application file for complete search history.

(56) References Cited

U.S. PATENT DOCUMENTS

| | | | | |
|---|---|---|---|---|
| 6,793,373 | B2 * | 9/2004 | Matsuba et al. | 362/260 |
| 7,753,556 | B1 * | 7/2010 | Zhang et al. | 362/249.02 |
| 7,824,075 | B2 * | 11/2010 | Maxik | 362/294 |
| 8,052,300 | B2 * | 11/2011 | Zhang et al. | 362/249.02 |
| 8,104,929 | B2 | 1/2012 | Kovalchick et al. | |
| 2008/0144178 | A1 | 6/2008 | Dillon et al. | |

OTHER PUBLICATIONS

Office Action dated Dec. 19, 2012 for Canadian Application No. 2,782,267 which is Applicant's coresponding application in Canada.
Examiners 2nd Report from Canadian Patent Office, dated Jun. 4, 2013, 2 pages.
StressCrete Group—Innovation Advanced Technology Excellence in Engineering—Web page dated Nov. 20, 2008 (1 page).
Beta LED: Uncompromising Brillance "The EDGE Family of Products"—Web page dated Nov. 20, 2008 (2 pages).
Kim Lighting "Luminaire Configurator"—Web page dated Nov. 20, 2008 (1 page).
Philips Lumec: LifeLED Technical Information—Web page dated Nov. 20, 2008 (3 pages).

* cited by examiner

*Primary Examiner* — Robert May
(74) *Attorney, Agent, or Firm* — Seyfarth Shaw LLP

(57) ABSTRACT

A lighting system utilizing light-emitting diodes (LEDs) and methods for configuring lanterns thereof are disclosed. The lantern includes a roof or canopy that includes fans that span directly between the electronics and LEDs for improved heat dissipation, the fans preferably formed integral with the canopy. The LEDs are mounted on easily mounted and removed modular printed circuit boards, in at least two different sizes and numbers of LEDs, and optical lenses of at least two different lighting patterns are provided, so that the lantern may be assembled or retrofit according to a desired application including candlepower and lighting pattern for cast light. The optical lenses are individually provided, utilize refraction to diminish reflection, and, in one form, incorporate an integral reflector to assist in defining a lighting pattern. In some forms, a securement may be provided for individual securement of lenses with the PCB.

5 Claims, 27 Drawing Sheets

LIGHTING SYSTEM WITH LIGHT-EMITTING DIODES AND SECURING STRUCTURE

FIELD OF THE INVENTION

The invention relates to a lighting system utilizing light-emitting diodes (LEDs) and, in particular, to a LED-based lamp or lantern with removable circuit boards, with improved heat-dissipation, and with novel light-directing lenses.

BACKGROUND

Specialized diodes as light-emitting devices have slowly been incorporated into more and more applications. In virtually every application, particularized technical issues have presented themselves, issues that arise both from starting with older designs and from the inherent characteristics of light-emitting diodes, or LEDs.

LEDs have several major benefits in comparison to non-LED lighting. If properly installed and treated, an LED has a longer life span than many comparable light elements. Thus, LEDs have been or work is being undertaken to devise manners to incorporate LEDs into applications where it is costly and/or difficult to replace the light elements. Relative to size, an LED can produce a greater amount of light, measured in lumens, than a comparatively sized non-LED light. For this reason, LEDs have been incorporated into many applications requiring small-sized light elements. Related to the greater light is the ability of LEDs to provide more light relative to power consumption than other lighting.

As an LED provides more light, the obvious corollary of greater light with respect to power consumption is that an LED wastes less power in the form of heat. While this is true, a large portion of generated heat is lost not on the light-emitting side of the diode, but instead at its base. The diode, which would be recognized as an electrical circuit component, is typically mounted on a printed wiring or printed circuit board, referred to herein as a PCB. The heat generated by the diode is initially transferred to the PCB, and the PCB is often heat-sinked in some manner. An 8-watt LED that has been properly installed and has proper heat dissipation may have a ten-year life span of daily 8-hour usage, while the same LED may fail in approximately twenty minutes without a heat sink.

Some efforts have been made to incorporate LEDs into pole or stanchion-type lights, such as what would typically viewed as an outdoor lamp or lantern and may be referred to as a streetlight. Traditional streetlights require bulb replacement and exhibit a heavy electrical cost burden for municipalities, shopping centers, retail establishments, and commercial zones, for example. In line with traditional approaches to construction, LED-based streetlights have an internal assembly that is mounted inside of an outer shell. The internal assembly is hardwired with the LEDs and, often times, each individual LED is separately mounted with the internal assembly. Beyond the labor required, each LED must be ensured of proper mounting so that the heat dissipation is proper, and the LEDs and connecting wires are susceptible to damage during handling and manufacture. Moreover, these designs are difficult or impossible to reconfigure or retrofit (such as altering the lighting elements) or replace/repair.

This internal assembly typically includes a main body formed of cast aluminum for the heat dissipation or heat sinking properties. The body often includes a top surface or area that includes fans to increase the surface area with the atmosphere. However, when the internal assembly is mounted within its outer shell, the fans are exposed to a cavity of air within the shell, and the air acts as an insulator. The result is that this type of prior art LED light has poor heat dissipation beyond the heat sink.

An LED is not unlike a traditional light-emitting element in that the element itself does little to control the direction of cast light. For many applications, and most outdoor applications, established patterns of cast light are usually specified. These patterns are often referred to by definitions provided by the Illuminating Engineering Society (IES). For instance, a Type III pattern is an oval or elliptical pattern wherein the light is cast in lateral directions from the lantern, while Type IV is similar to Type III, but the former casts the oval in a forward direction relative to the lateral directions. Both Type III and Type IV patterns may be specified for streetlighting in a residential area so that a lantern mounted proximate to but out of the roadway casts its light principally downward and into the street, and does not cast appreciable light towards the residences along the roadway. A Type V pattern is a generally symmetrical distribution.

In some applications, there is also a "cutoff" specification for determining how much light may be cast upwards from the lantern, demonstrating a concern for "light pollution" and light nuisance in urban areas. The IES defines a "full cutoff" as zero lumens at 90 degrees from vertical plumb or nadir. "Cutoff" requires 2.5% or less of total candlepower (i.e., measured lumens) at 90 degrees from nadir, while "semicut-off" requires 5% or less at 90 degrees from nadir.

The construction of the lantern itself creates issues for satisfying the pattern and cutoff specifications. In one prior art LED-based lantern, the LEDs are individually mounted in a ring around a circular internal assembly. The internal assembly includes a central support for positioning the ring to have the LEDs direct light downward in a generally circular pattern, and the central support includes a reflective surface formed on a concave cylinder. While the reflective surface serves to distribute light outward, the lower portion flares outwardly so that downward rays are reflected laterally, the concomitant result being that light is also reflected upwardly.

The principal manner used to control the throw or cast of light is reflective lenses. In a typical lantern, the outer shell includes a top portion or canopy, and light is emitted outward from the lantern below the canopy. In order to promote the low cutoff properties, the canopy also extends outwardly (horizontally) beyond any lens and is solid and opaque. A first style of lens is generally a translucent body or series of panels extending from the lower skirt of the canopy to a top of a lantern base, the base also being solid and opaque and providing structure support between the lantern and the stanchion upon which it is mounted. This style of lens may be clear, may be frosted, may have a pattern formed on the surface of the lens to reflect the light in a specific direction, or a combination of both. These lenses are heavy, and they can be expensive to manufacture and replace (such as when struck by vandals) or change (such as when the light Type pattern is to be changed).

Another style of lens is sometimes referred to as an "optic" or to as "optics." This style utilizes a separate lens dedicated to a singular light-emitting element, though a plurality of lenses may be formed as a sheet. The individual lenses are placed close to the LEDs to generally capture most of the light from the LED and may be used to reduce the overall size requirements for the assembly.

A common drawback of the above-described prior art lanterns is the use of reflection to direct the light rays. As is know, reflection is the physical principal of a light ray hitting a reflective barrier, broadly treated herein as an internal or external surface or boundary for which a light ray strikes at an angle of incidence, the light then being turned away from the boundary at an angle of reflection. Reflection of light results in certain portion of the rays being lost to diffusion, for a variety of reasons. At a minimum, the lost rays are wasteful; at a maximum, they can be reflected at greater than 90 degrees to the nadir.

Accordingly, there has been a need for an improved light assembly and, in particular, an improved LED-based lantern assembly.

SUMMARY

In accordance with an aspect, a lantern is disclosed including a canopy having an outer surface externally exposed to atmosphere for heat dissipation thereto and heat sink structure integrally formed with the outer surface, heat-producing lighting elements, and a mounting substrate from mounting the lighting elements, wherein the canopy is adapted for securing the mounting substrate to the heat sink structure for dissipation of heat from the lighting elements.

In some forms, the lighting elements are light emitting diodes (LEDs). The mounting substrate may include a printed circuit board (PCB) upon which the LEDs are mounted. The lantern may include a fixture plate mounted between and in physical contact with both the PCB and the heat sink structure.

In another aspect, a method of configuring a light emitting diode (LED)-based lantern is disclosed including the steps of selecting a lighting application including a lighting pattern and candlepower, selecting two or more lighting element assemblies in accordance with the lighting application, mounting each selected lighting element assembly within a lantern, and wiring each selected lighting element with the lantern.

In some forms, the step of mounting each selected lighting element assembly includes mounting each selected lighting element assembly with a fixture plate, and mounting said fixture plate within said lantern. The step of mounting said fixture plate may include mounting the fixture plate in physical contact with a canopy of the lantern. The step of mounting said fixture plate may include mounting the fixture plate in physical contact with a heat sink structure integrally formed with the canopy and mounting the fixture plate in physical contact with each selected lighting element assembly.

In some forms, the step of selecting one or more lighting element assemblies includes providing lighting assemblies having at least two different configurations. The step of providing the configurations may include providing each configuration with a shape for a printed circuit board (PCB) on which lighting elements are mounted, and providing each configuration with a number of lighting elements producing a predetermined candlepower. The step of providing the configurations may include providing each configuration with a lighting pattern for light cast from the lantern, wherein at least two of the lighting assembly configurations have different lighting patterns. The step of providing each configuration with a lighting pattern may include providing a lens over each lighting element, and the step of selecting one or more lighting assembles includes selecting the lighting pattern provided by the lens thereof.

In some forms, the method includes the steps of providing a plurality of lenses, the lenses providing at least two different lighting patterns, selecting lenses based on a selected lighting pattern, and mounting the selected lenses with each of the selected lighting element assemblies. The method may include the step of removing previously mounted lighting assemblies. The method may include the step of removing previously mounted lenses.

In some forms, the method includes the step of initially providing a previously assembled lantern.

In a further aspect, a method of constructing a light emitting diode (LED)-based lantern is disclosed including the steps of providing an individual lens for each LED, providing an individual lens securement for each lens and each LED, mounting each securement proximate the LED, and securing each lens with a respective LED.

In some forms, the method further includes the steps of providing a solder pad for connecting the LED, providing a solder pad for mounting each securement, and solder-reflowing the LED and securement solder pads simultaneously.

In some forms, the step of securing each lens includes snapping the lens into the securement.

In still a further aspect, an optical lens for a light emitting diode (LED) is disclosed comprising a base, a cavity formed in the base, the cavity having an inner surface proximate an LED when mounted in a lighting assembly, and a first portion of the lens including a structure for casting light therefrom in a radial and annular pattern, wherein the optical lens at least partially refracts light therethrough.

In some forms, the first portion has a radial extent no greater than half of the base, the optical lens further including a second portion for refracting light away from a radial direction. The optical lens may be used in directing light away from an undesired direction, wherein light emitted from the LED at least partially towards the undesired direction is refracted by and emitted from the second portion less towards the undesired direction and more towards a lateral direction to the undesired direction.

BRIEF DESCRIPTION OF THE DRAWINGS

In the Figures.

DETAILED DESCRIPTION

Figure 1:
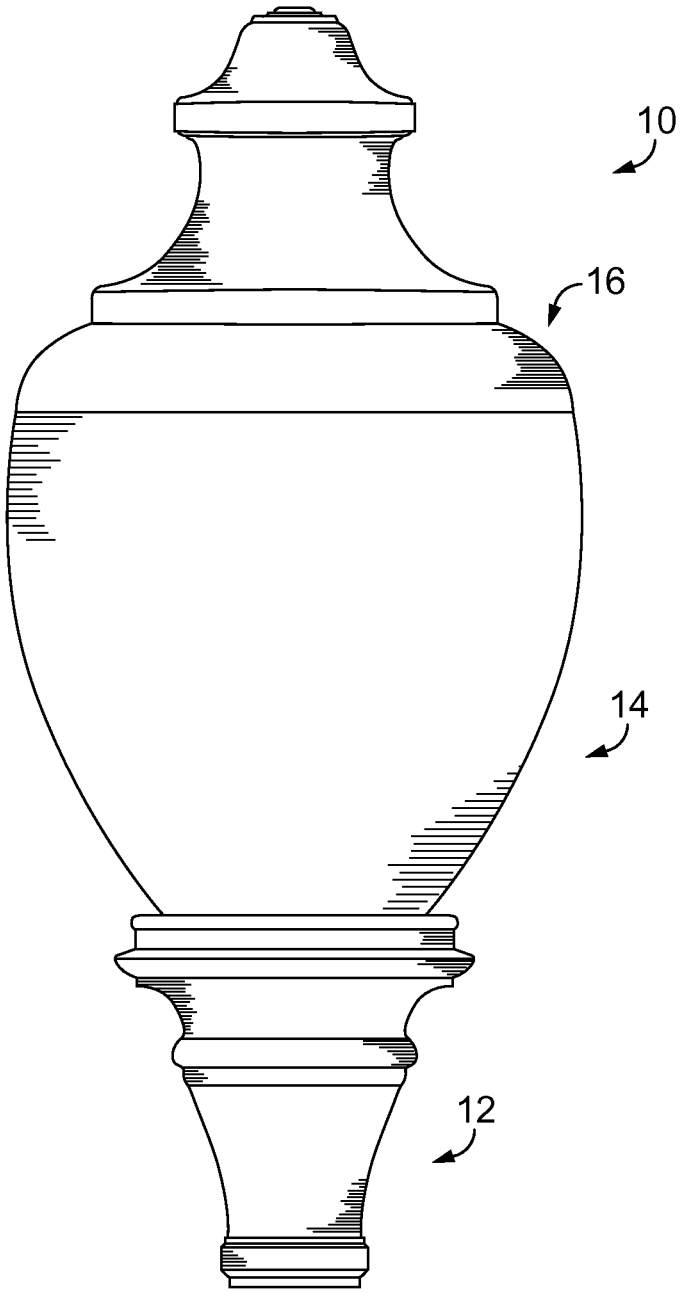
FIG. 1 is a side elevation view of a representative lantern for mounting on a support or stanchion, such as for an outdoor lighting application.

Referring initially to FIG. 1, the exterior of a first form of a lantern 10 is illustrated with a visual appearance and construction consistent with prior art lanterns and non-LED-based lanterns such as would commonly be installed in outdoor applications. The lantern 10 includes a base portion 12 for securing the lantern 10 with a stanchion or support or lamppost at a desired height for distributing light from the lantern 10. The base portion 12 also provides an internal path and housing for some electrical components (not shown), and the base portion 12 supports (either directly or indirectly) the other components of the lantern 10. The other components of the lantern 10 include an external lens or globe 14 and a canopy 16.

Figure 2:
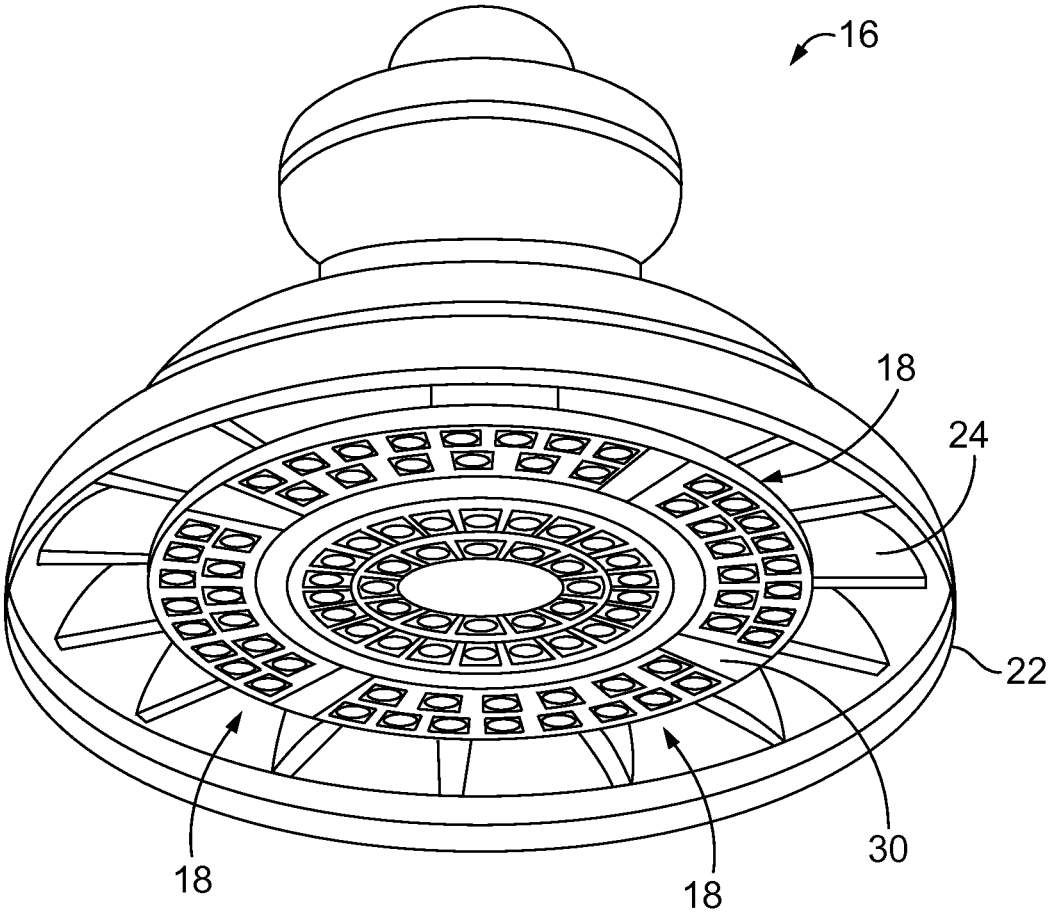
FIG. 2 is a perspective view of a canopy of the lantern of FIG. 1 showing an internal assembly including a fixture plate and a plurality of printed circuit boards mounted to the fixture plate, each of the printed circuit boards including a plurality of light-emitting diodes (LEDs) mounted thereon.

Turning now to FIG. 2, the canopy 16 is shown with several lighting element assemblies 18 secured therein. In the present embodiment, the lighting element assemblies 18 are each secured to a plate fixture 20, as are other components discussed below. As can be seen, the lighting element assemblies 18 are secured above and recessed from a lower edge 22 of the canopy 16 so that the canopy 16 and lighting element assemblies 18 are suitable for full cutoff applications. However, in the event the illustrated globe 14 is a diffuser, the globe 14 extending laterally beyond the edge 22 of the canopy 16 likely renders the globe 14 unsuitable for such.

Figure 3:
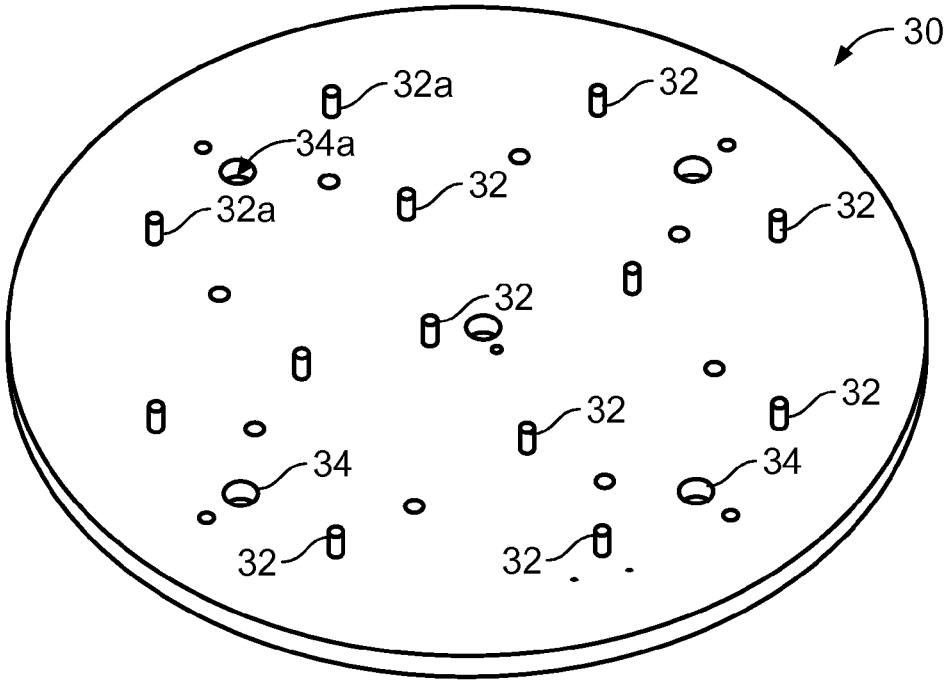
FIG. 3 is a perspective view of the fixture plate of FIG. 2.
Figure 6:
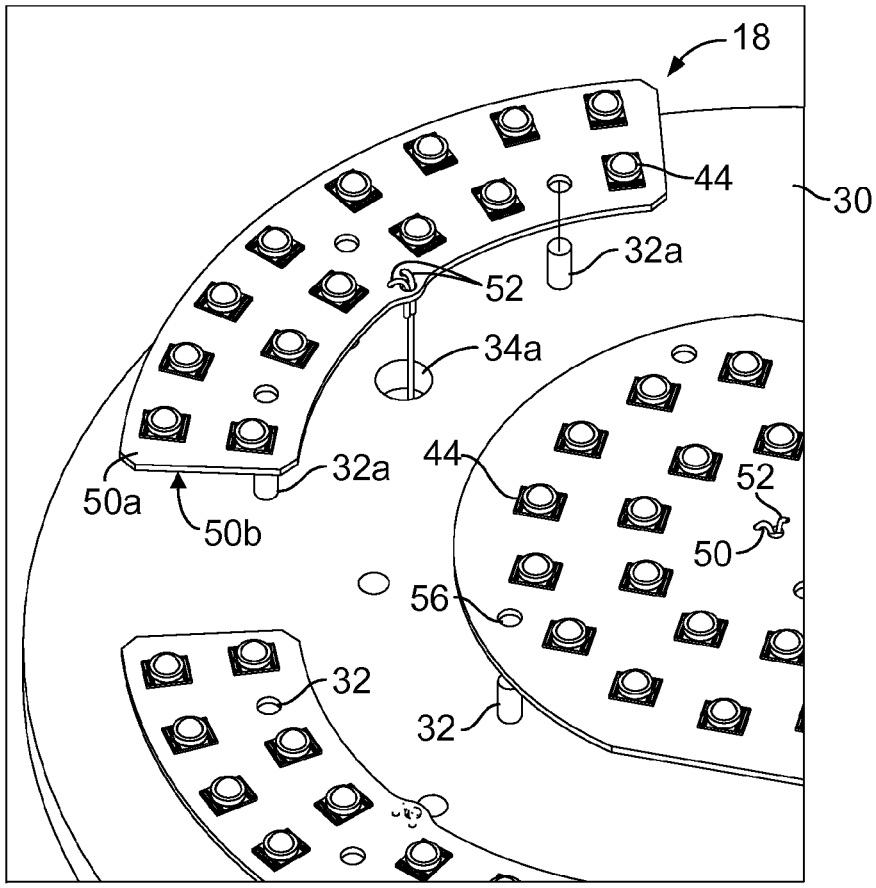
FIG. 6 is a perspective view of the fixture plate, a semi-circular one of the printed circuit boards mounted thereon, a second semi-circular one of the printed circuit boards in an assembly step with the fixture plate, and a circular one of the printed circuit boards in a second assembly step with the fixture plate.

The lighting element assemblies 18 are secured with a fixture plate 30 depicted in FIG. 3. In the illustrated form, the fixture plate 30 is a relatively thin disc with a high thermal conductivity. The fixture plate 30 may be metal such as aluminum or another material that easily conducts heat. For each of the lighting element assemblies 18, a plurality of mounting posts 32 and at least a single wiring hole 34 are provided. As can be seen by comparing FIGS. 3 and 6, a single lighting element assembly **18*a* is provided with a pair of mounting posts 32*a* and a wiring hole 34*a*. The fixture plate 30 also includes mounting holes 36 for securing the fixture plate 30 with the interior 24 of the canopy 16**, such as by receiving a screw (not shown) therein.

FIG. 2 illustrates a plurality of the lighting element assemblies 18 having different configurations and, specifically, illustrates four individual arc or semi-circular or partial-circular lighting element assemblies 40 and a single circular lighting element assembly 42. The lighting elements assemblies 40 and 42 each hold a set of lighting elements in the form of light emitting diodes or LEDs 44 so that each of the lighting element assemblies 18 may include a subset of the total LEDs installed in a particular lantern 10. In this manner, the amount of candlepower or lumens provided by the lantern 10 is scalable based on the number and arrangement of the lighting element assemblies 18 installed. For instance, FIG. 5 illustrates the circular lighting element assembly 42 as having twenty-six LEDs 44, and such may be installed in a lantern 10 as the only lighting element assembly 18. Alternatively, a lantern 10 may include fewer, such as two or three, of the illustrated arc lighting element assemblies 40, and the lantern 10 may be constructed with or without the central circular lighting element assembly 42, so that the number of LEDs and, hence, the amount of candlepower provided by the lantern 10 is easily selected without other components of the lantern 10 being affected. In a further alternative, a lighting element assembly (not shown) may simply have a configuration of a different number of LEDs, such as a circular lighting element assembly similar to that of FIG. 5 but having only one of the inner or outer illustrated circles 44*a*, 44*b* of LEDs 44. The lighting element assembly 40 of FIG. 4 may similarly be modified. In contrast, prior art LED lanterns utilize a single lighting element assembly, rendering the lantern non-scalable.

Figure 4:
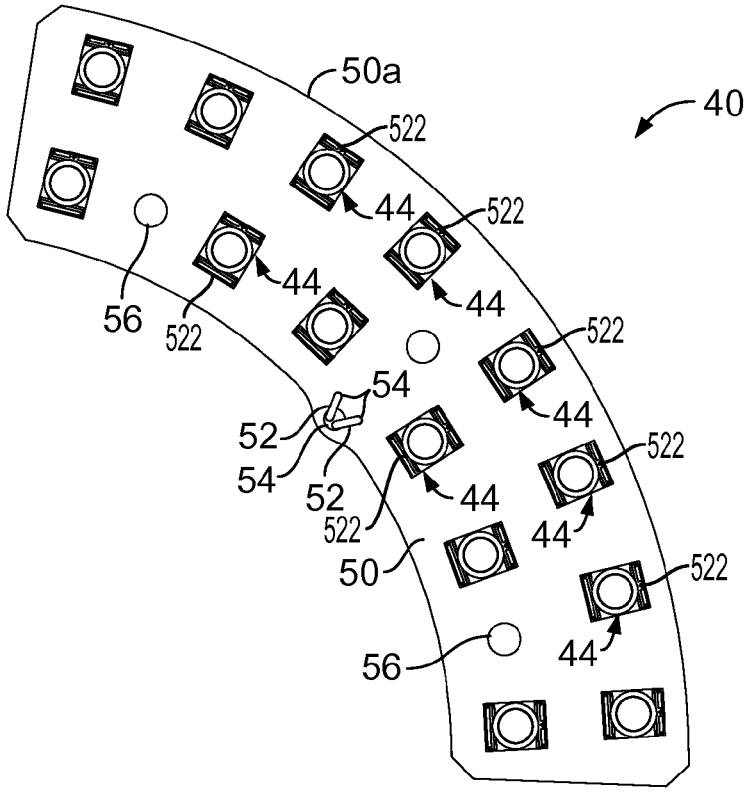
FIG. 4 is a top plan view of a semi-circular one of the printed circuit boards of FIG. 2.
Figure 5:
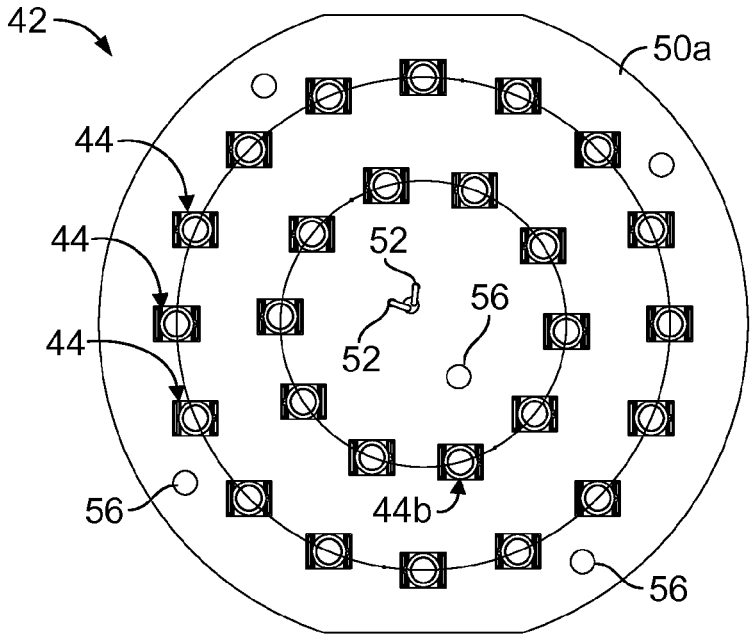
FIG. 5 is a top plan view of a circular one of the printed circuit boards of FIG. 2.

Focusing on FIG. 4, each of the lighting element assemblies 18 includes a printed wiring or printed circuit board (PCB) 50. In a preferred form, the PCB 50 is formed of FR4, a well known substrate material, or another material that promotes heat dissipation from the LEDs 44 mounted thereon. The PCB 50 includes a trace wiring layer (not shown) connected to input/output wires 52 for receiving power and forming an electrical circuit with the lantern. In a preferred form, the array of LEDs 44 is wired with pairs of LEDs 44 in parallel, and each pair then wired in series with the other pairs.

Notably, the lantern 10 locates the other electronic circuitry elsewhere and not on the PCB 50. For instance, a secondary board (not shown) may be located above the fixture plate 30, or may be located in the base. In any event, regardless of the selection of one or more lighting element assemblies 18, the control electronics are not redundant and can easily be connected with the lighting element assemblies 18. This also reduces waste should one of the lighting element assemblies be replaced.

Preferably, each wire 52 passes through two bores 54 before being soldered into connection and with the PCB 50, a structural feature that diminishes the susceptibility of the lighting element assembly 18 to damage by handling or transit, for instance. For each LED 44, solder pads are formed on the PCB 50 for electrical connection and mounting of the LED 44 on a front side 50*a* of the PCB 50. In a preferred form, the PCB 50 includes a back side 50*b* (FIG. 6) provided with a foil layer (not shown), preferably of aluminum, for promoting heat dissipation. The PCB 50 includes mounting holes 56 for securing the PCB 50 with the mounting posts 32 of the fixture plate 30, such as via screws (not shown). Mounting of the lighting element assemblies 18 with the fixture plate 30, and the fixture plate 30 with the canopy 16, are relatively simple steps that allow a technician to assembly the lighting element assemblies 18 and fixture plate 30 within the lantern 10 according to a customized selection, including retrofitting or changing the components in a field-installed application. This feature is further promoted by the lighting element assemblies 18 being robust and self-contained, without requiring a technician to individually mount the LEDs 44, as is the case with most prior art applications.

Figure 7:
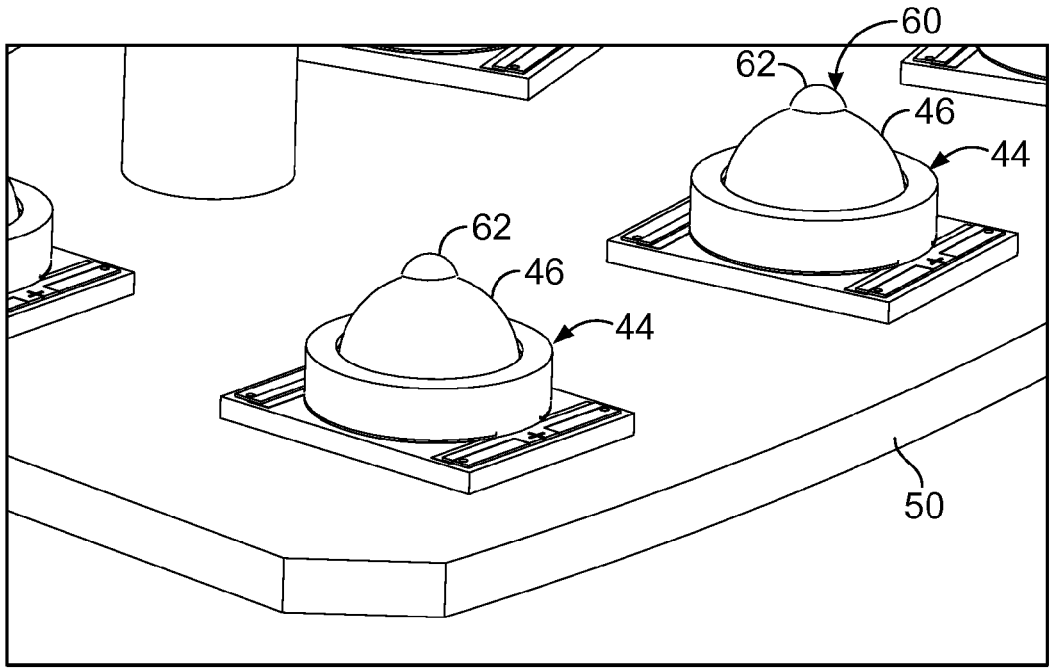
FIG. 7 is a perspective view of LEDs mounted on one of the printed circuit hoards showing optical gel applied to the LED.
Figure 8:
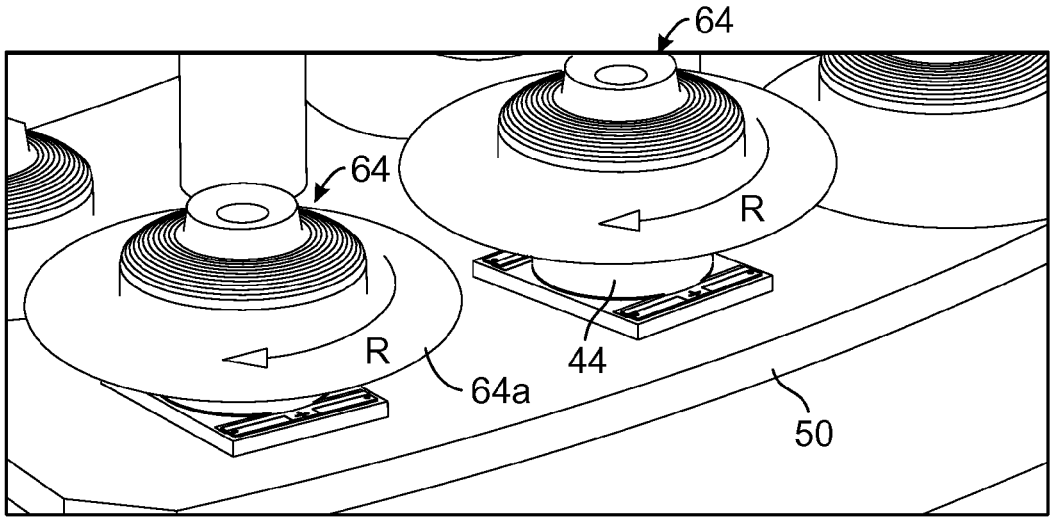
FIG. 8 is a perspective view of LEDs mounted on one of the printed circuit boards showing assembly steps for disposing optic lenses on the LEDs.
Figure 9:
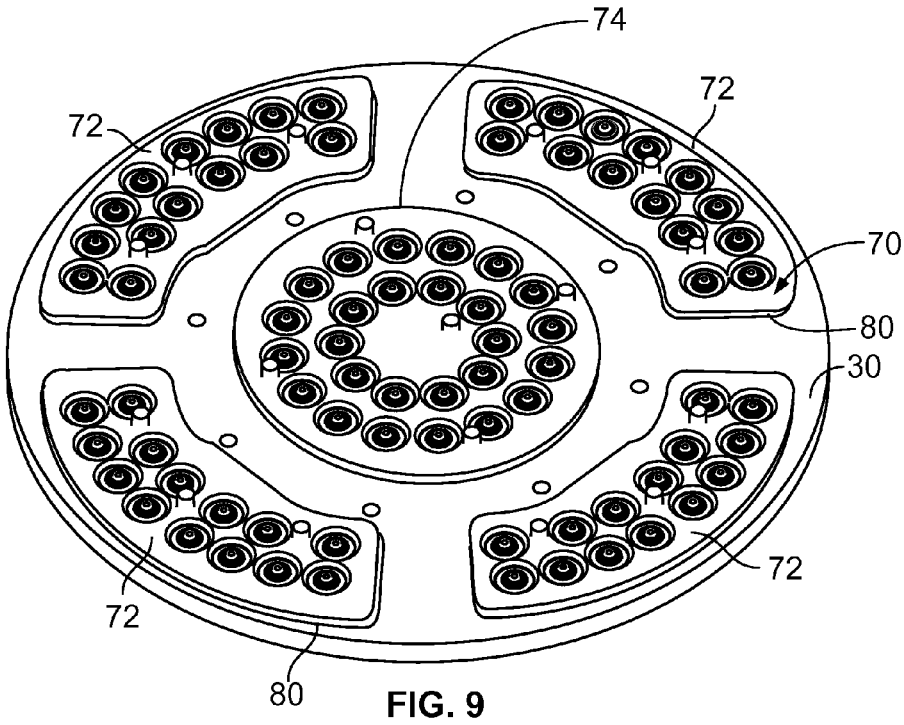
FIG. 9 is a perspective view of the fixture plate and printed circuit boards of FIG. 2 with cover plates mounted over the LEDs, printed circuit boards, and optic lenses.

Turning now to FIGS. 7 and 8, LEDs 44 mounted to a PCB 50 are shown. As is known, an LED 44 includes a clear, vitriform covering 46 through which emitted light passes. In one form, the lantern 10 utilizes refraction to direct emitted light from the LEDs, as opposed to the reflection employed by prior art lanterns. In some forms, this is promoted by providing each LED covering 46 with an amount of optical gel 60 and a lens 64 that least partially refracts light. The optical gel 60 is applied as a gel drop 62 to the covering 46 (FIG. 7). A commercially-available optical gel marketed as _____ by the _(company)_ of _(location of company)_ may be used, as an example. As best seen in FIG. 8, individual lenses 64 are then disposed over the LEDs 44, mounting with light pressure (as the LED covering is relatively susceptible to damage by focused pressure) and a rotating motion (arrow R) in order to distribute the optical gel 60 within a cavity (discussed below) formed on the bottom side 64*a* of the lens 64. Preferably, the optical gel 60 fills any interstitial volume that light may pass between the LED covering 46 and the lens 64. The optical gel 60 reduces or eliminates boundary deflection, reflection, and diffusion that would normally occur without the optical gel 60 at the boundary between the covering 46 and air and between the air and the lens 64. During manufacturing and assembly of the components, the optical gel 60 also provides a retention force to retain the lens 64, at least temporarily, with the light element assemblies 18. It should be noted that, while a preferred embodiment utilizes the plurality of lenses 64, it is within the scope of forms of the inventions described herein to utilize a single lens (not shown) for multiple LEDs 44. It should be noted that in another form discussed below the optical gel 60 may be obviated.

With reference to FIGS. 9-13, the next step in assembly is providing one or more cover plates 70 for each lighting element assembly 18. With initial reference to FIG. 9, each of the lighting element assemblies 18 has an individually sized and mounted cover plate 70 such that arc cover plates 72 are provided for the arc light element assemblies 40 and a circular cover plate 74 is provided for the circular light element assembly 42.

The cover plates 70 include openings 76 for the LEDs 44. More specifically, the openings 76 allow the light emitted from the LEDs 44 to pass through and, in the preferred form, at least a portion of the lens 64 is disposed within the openings 76. In the present form, a single opening 76 is provided for each lens 64 and LED 44.

Figure 12:
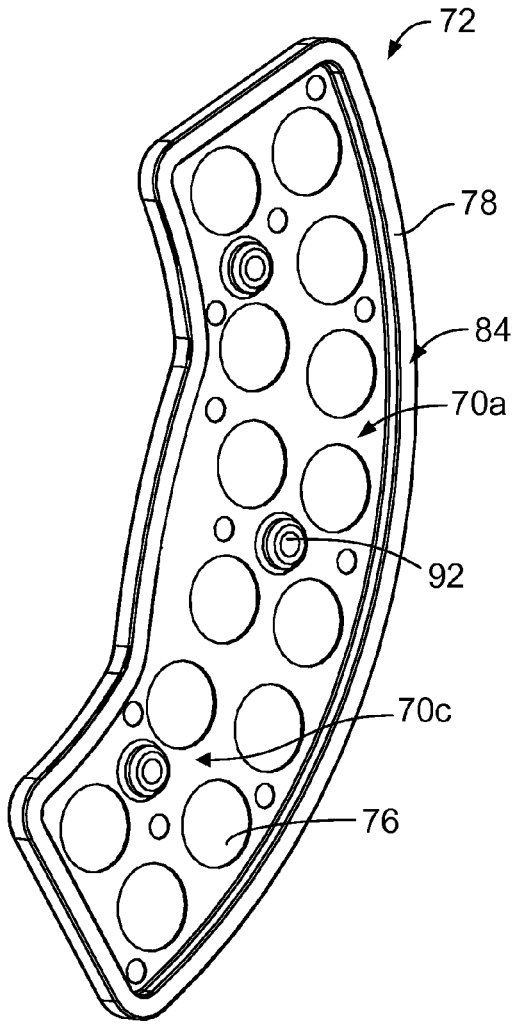
FIG. 12 is a second perspective view of an inner side of the semi-circular cover plate of FIG. 11.
Figure 13:
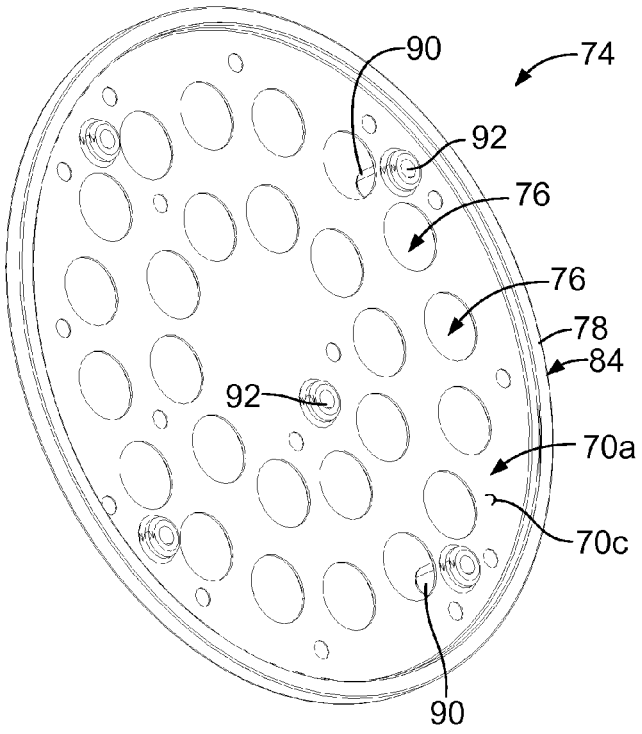
FIG. 13 is a perspective view of an inner side of the circular cover plate of FIG. 11.
Figure 14:
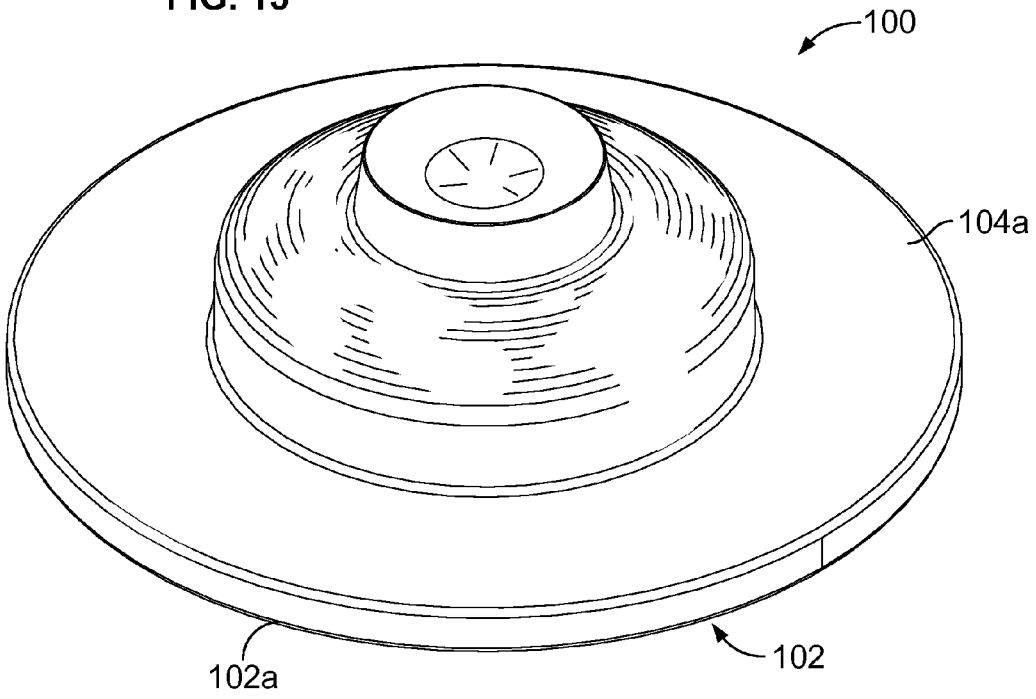
FIG. 14 is a top perspective view of the optic lens of FIG. 8.

Each opening 76 and the cover plate 70 are designed to minimize interference with light being emitted, while also providing a degree of weather element protection. Towards this end, each cover plate 70 is larger than that PCB 50 of the lighting element assembly 18 for which the cover plate 70 is provided, and an outer gasket 80 is secured at the peripheral edge 78 of the cover plate 70 for sealing with the fixture plate 30. The cover plate 70 also includes lens gaskets 82 (FIG. 10) positioned around each opening 76 for sealing with the lens 64 received within the opening 76. In FIGS. 12 and 13, the rear sides 70*a* of the cover plates 70 include a rim 84 on which the peripheral edge 78 is formed, the rim 84 and outer gasket 80 providing a stand-off for a top surface 70*b* of the cover plate 70 from the fixture plate 30, thereby allowing the cover plate 70 to receive the light element assembly 18 within a slight cavity 70*c* formed within the rear side 70*a* of the cover plate 70.

The size of the rim 84 also provides for the lens gaskets 82 mounted on the cover plate rear side 70*a* around the openings 76. That is, the stand-off provided by the rim 84 positions the cover plate 70 over the lenses 64 with the lens gaskets 82 therebetween.

The cover plate 70 is secured with the light emitting assembly 18 and with the fixture plate using posts 90 formed in the cover plate 70. As can be seen in the Figs., the posts 90 extend from the cover plate top surface 70*b*; while not shown, in the present form the posts 90 have an internally threaded blind bore 92 at the rear side 70*a* so that a threaded member (not shown) passes through the fixture plate 30, through the PCB 50, and into the posts 90. The threaded members can be tightened to compress the gaskets 80, 82 against the lenses 64 and fixture plate to seal the light element assembly 18 from weather elements at those interfaces.

Figure 10:
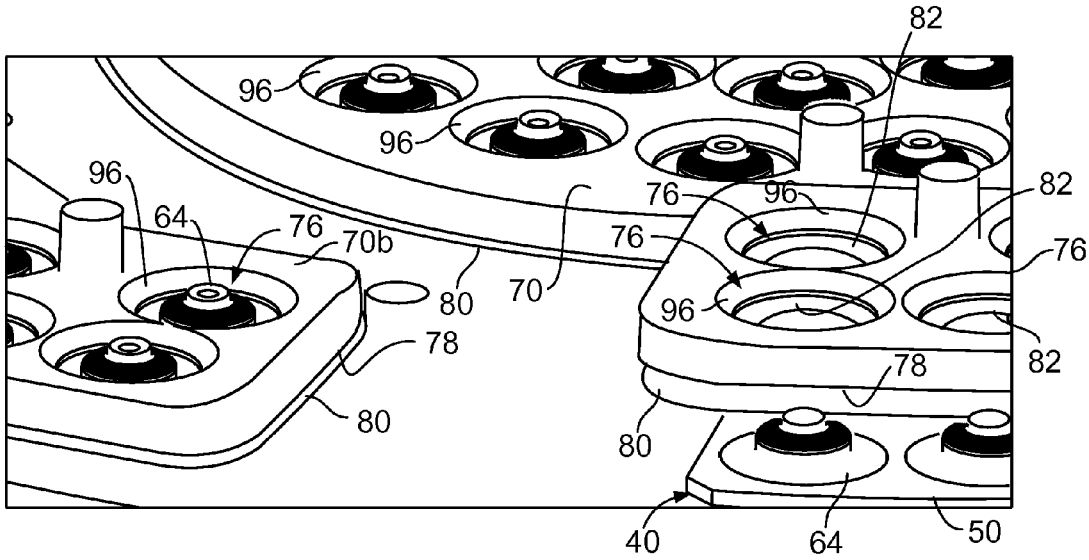
FIG. 10 is a perspective view of a portion of the fixture plate and printed circuit boards with LEDs mounted thereon of FIG. 8 showing a cover plate of FIG. 9 being mounted thereon.
Figure 11:
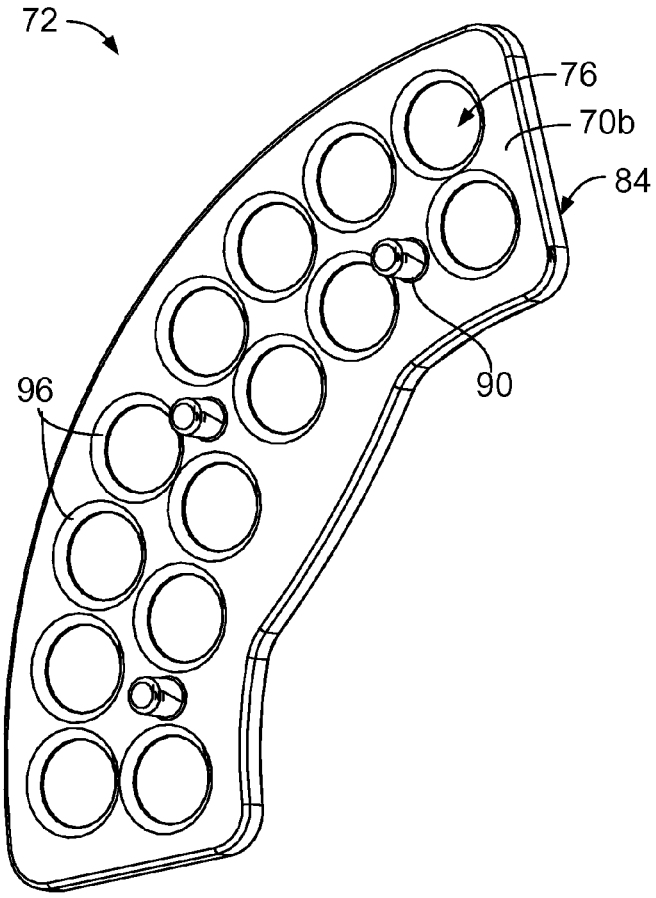
FIG. 11 is a first perspective view of an outer side of a semi-circular one of the cover plates of FIG. 9.

As best seen in FIGS. 10 and 11, the cover plate 70 includes a bevel 96 surrounding each opening 76. Recognizing the top surface 70*b* of the cover plate 70 is positioned away from the LED 44 itself (due to the lens 64, and the gasket 82 thereat, e.g.), the bevel 96 reduces any interference the cover plate 70 has on the emission of light from the LED 44 and lens 64.

Figure 15:
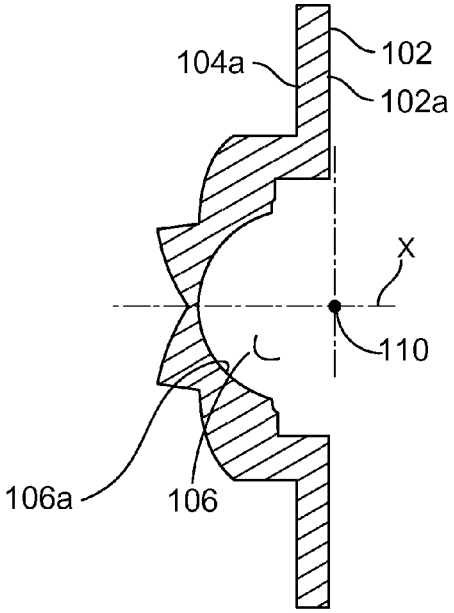
FIG. 15 is a cross-sectional view of the optic lens of FIG. 8.
Figure 16:
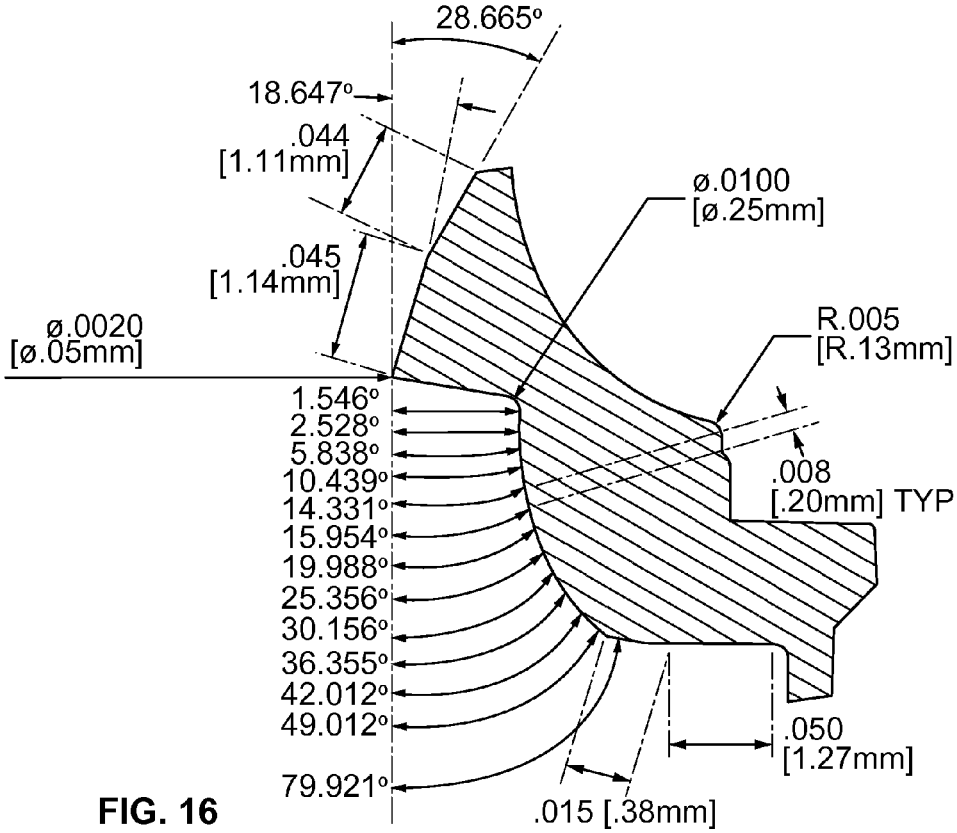
FIG. 16 is a detail of the view of FIG. 15 showing angles along various points of an external surface for distributing light from an LED.
Figure 17:
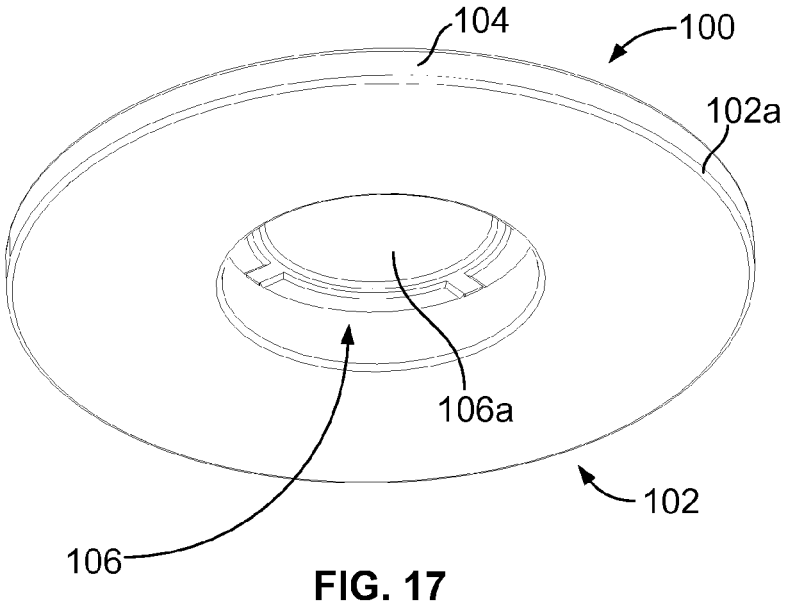
FIG. 17 is a bottom perspective view of the lens of FIG. 8.

In preferred forms, each lens 64 is molded of optically clear and UV stabilized acrylic, the acrylic having a 1.49 refractive index. Turning now to FIGS. 14-18, a lens 64 in the form of a symmetrical lens 100 is illustrated, the symmetrical lens 100 providing a generally circular light pattern and being known as a Type V lens under the IES pattern standard. The lens 100 includes a base 102 including a bottom side 102*a*. The base 102 includes a flange portion 104 extending radially outwardly and having a top surface 104*a*. When the cover plate 7 is secured over the lines 100, the lens gasket 82 is pressed against the flange top surface 104*a*. The base 102 is placed on and against the PCB 50 around an LED 44 mounted to the PCB 50. To enable this, the base 102 includes a central cavity 106 into which the LED 44 and the optical gel 60 is disposed. As can be seen in FIG. 15, the symmetrical lens 100 is designed to locate a photometric center 110 of the LED 44 along a center axial line X just below the plane P of the bottom side 102*a*.

Figure 18:
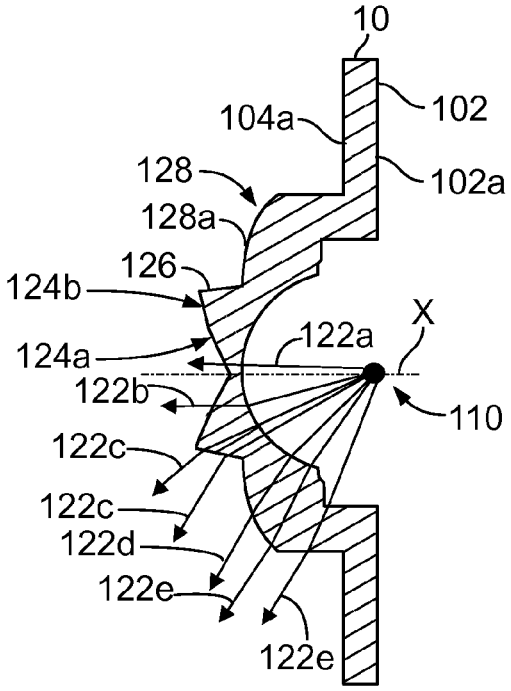
FIG. 18 is a side elevational view of the optic lens of FIG. 8 showing lines representing paths of light rays for a light ray emission pattern from an LED through the optic lens.
Figure 19:
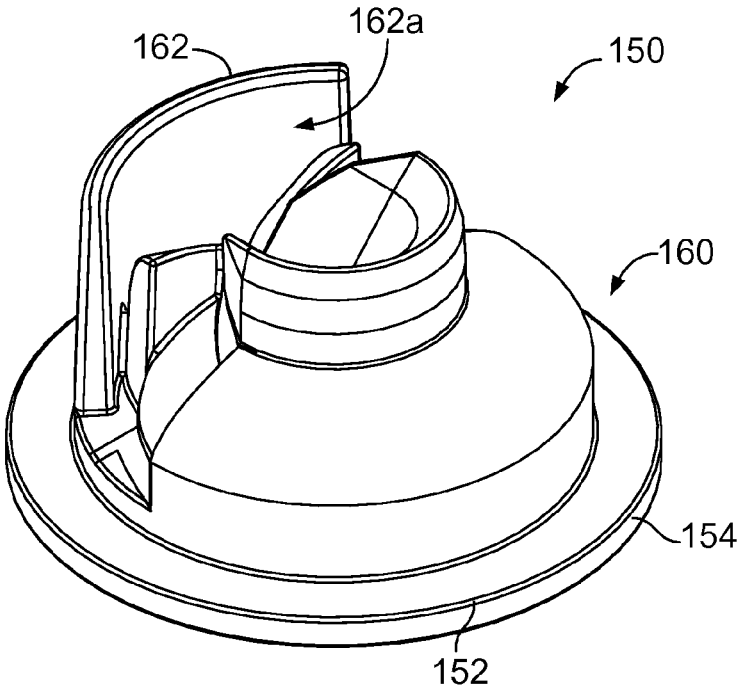
FIG. 19 is a perspective view of an alternative embodiment of an optic lens.
Figure 20:
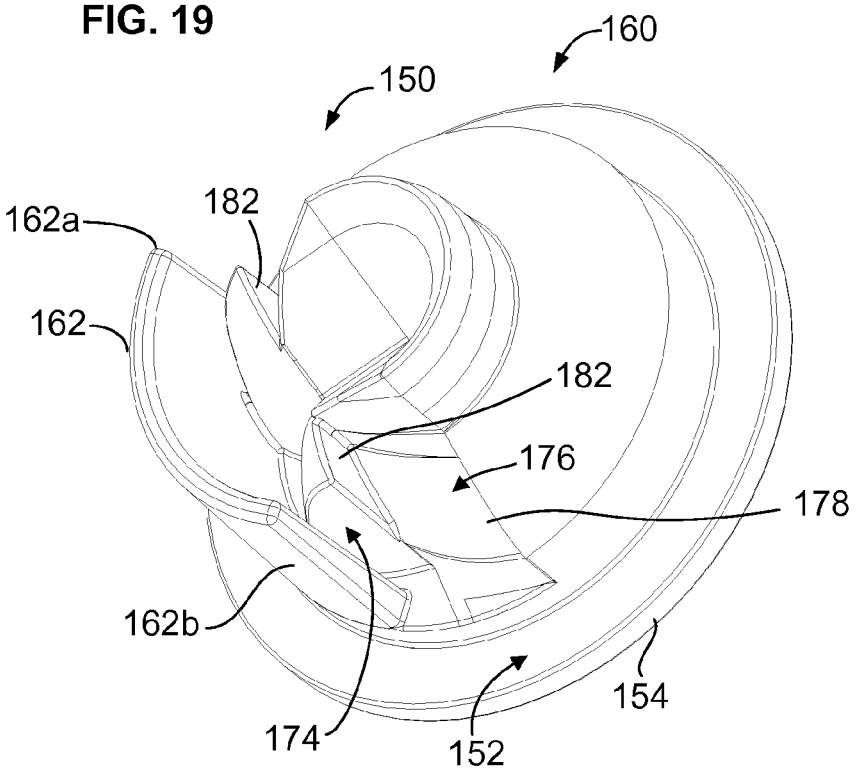
FIG. 20 is a second perspective view of the optic lens of FIG. 19.
Figure 21:
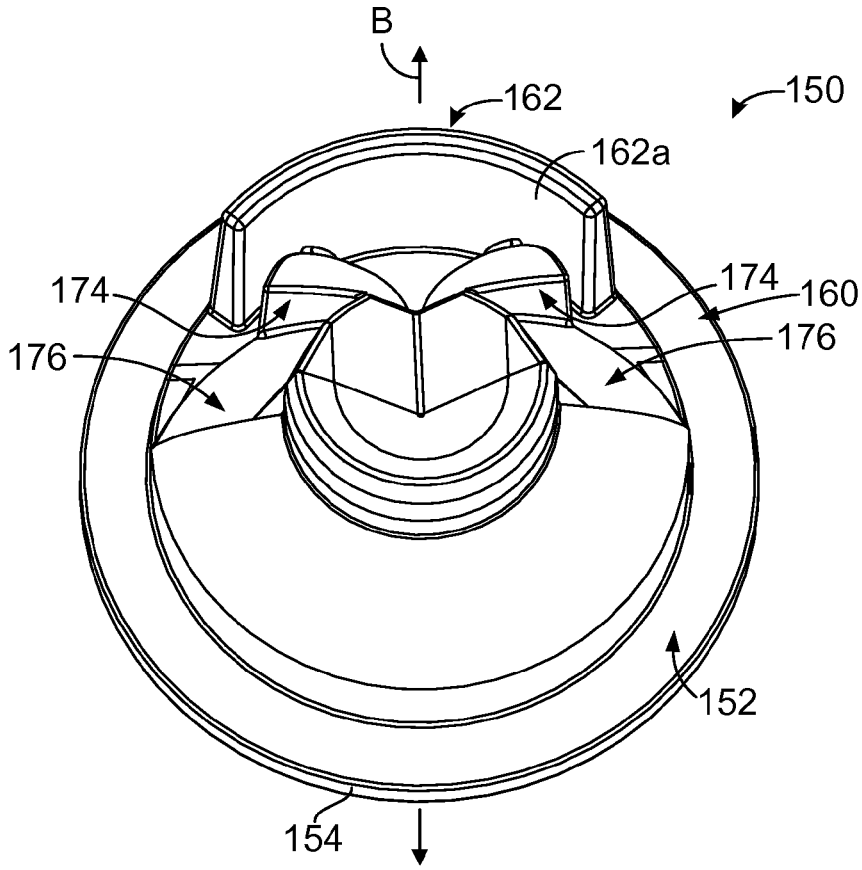
FIG. 21 is a third perspective view of the optic lens of FIG. 19.
Figure 22:
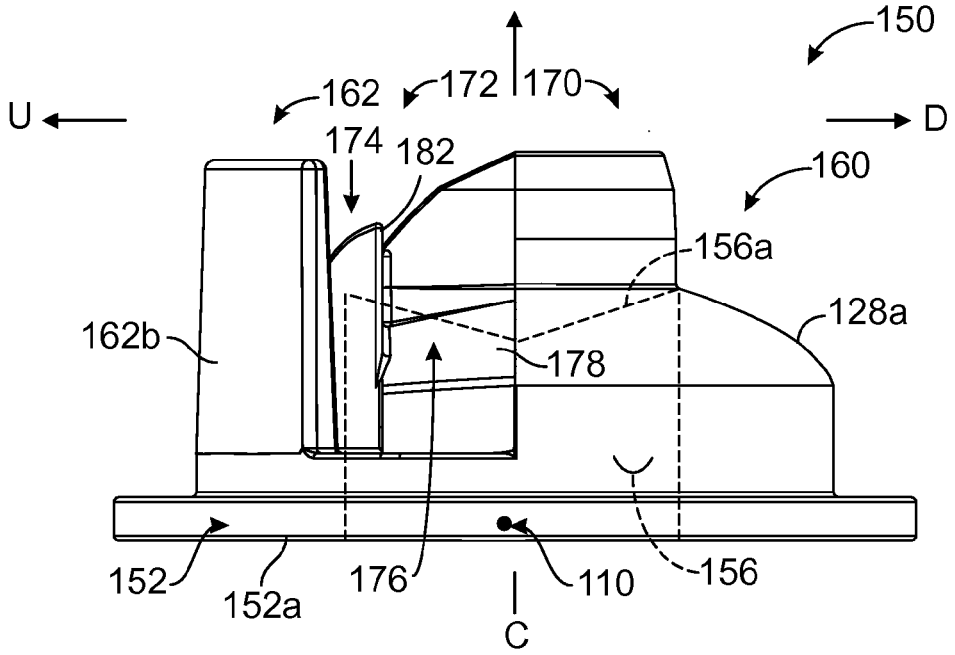
FIG. 22 is a side elevational view of the optic lens of FIG. 19.

The symmetrical lens 100 includes a light emitting portion 120 through which light from the LED 44 passes, best illustrated in FIG. 18 in which rays of light are represented as arrows 122. In the present form, there is little ability to control the direction of a center arrow 122*a* that passes orthogonally from the LED covering 46 and from the photometric center 110 thereof to and through the light emitting portion 120. A portion of the rays represented by arrow 122*b* immediately radially outward from the center arrow 122*a* are bent while passing from the LED 44 to the lens 100 and while exiting the lens 100 to the surrounding air. As can be seen, a central portion 124 of the lens 100 has a least a first and preferably a first and a second angle surface 124*a*, 124*b* that cause the rays 122*b* to be distributed somewhat evenly in emission from the central portion 124 surfaces 124*a*, 124*b*.

The combination of the refracting of the light 122 as it enters and leaves the lens 100 results in a large portion of the overall light 122 being directed outwardly, to some degree. That is, a portion of the light represented by arrows 122*c* is directed outwardly from the central axis defined by arrow 122*a* such that it is emitted from a surface 126 formed radially outwardly on the central portion 124. An arced profile is provided on a medial portion 128 to define an arced surface 128*a*, again resulting in light represented by arrow 122*d* being partially distributed radially outwardly. A emission base portion 130 includes a substantially vertical portion 130*a* that bends light forward so rays 122*e* converges somewhat with the rays 122*c* and 122*d*.

In this manner, the light pattern cast from the lens 100 forms a Type 5 light pattern. More specifically, each lens 100 provides a bright ring of rays 122, somewhat annular, with a center of the ring also somewhat illuminated due to rays 122*b* and 122*a*, for instance. The combination of plurality of lenses 100 provides a pattern of overlapping rings that, together, form the Type 5 light pattern, as can readily be understood from the array of LEDs 44 illustrated in FIG. 2, for instance. It can also be understood that, due to the angle for the rays 122*c-e*, that the light is cast on a surface with a radius; the farther the surface (such as a street or ground level surface surrounding a lantern 10) from the LEDs 44, the larger the radius for that light. Accordingly, LEDs 44 located in the center of the lantern 10 (such as that of FIG. 26) will nonetheless cast the vast majority of their light outwardly and not simply directly into the support located therebelow.

FIGS. 19-22 illustrate a lens 64 in the form of an asymmetrical lens 150 which may be designed to satisfy the IES standard Type III pattern. The asymmetrical lens 150 has a base 152 similar to that of the symmetrical lens 100, described above, and having a bottom side 152*a* (FIG. 22) and a flange 154 with a top surface 154*a*. However, while the symmetrical lens cavity 106 has an interior surface 106*a* that is generally hemispherical and concave (see FIG. 15), the asymmetrical lens 150 includes a central cavity 156 that with an interior surface 156*a* (see FIG. 22) that is conically shaped and extends into the cavity 156.

The lens 150 includes a light emitting portion 160 formed on the base 152. For prior art lanterns attempting to satisfy the Type III pattern, a metal structure such as a central pole is usually provided, some distance from the LED, to reflect light away from undesired directions, the pole providing little to no effective control over the direction of light and undesirably dispersing a significant portion of the light. For the present asymmetrical lens 150, a novel reflective shield portion 162 is provided as part of the lens 150 itself. The shield 162 is formed a short radial distance from the cavity 156 and extends axially. In a preferred embodiment, the shield 162 is frosted on front and rear surfaces 162*a*, 162*b*, and such surface treatment is provided during formation such as molding. The shield 162 serves to direct light from the LED 44 disposed in the cavity 156 minimally away from the undesired directions (generally in the directions of representative arrows U in FIGS. 22 and 23) and preferably towards the desired directions (generally in the directions of representative arrows D in FIGS. 22 and 23)

The light emitting portion 160 may generally be bisected into a semi-symmetrical half 170 and a non-symmetrical half 172, of which the shield 162 is a part. The semi-symmetrical half 170 has an outer shape generally like that of the symmetrical lens 100. What should be recognized from the above discussion of rays 122 for the lens 100 is that the rays 122 are refracted toward the normal when entering the lens 64 and are refracted away from the normal when exiting the lens 64, and the lens 150 behaves in the same manner. Rays 122 passing through the semi-symmetrical half 170 are refracted in the same manner as illustrated in FIG. 18, discussed above.

Each lens 64 discussed herein attempts to minimize the rays 122 that simply pass straight through the lens 64, such as rays 122*a* and 122*b* in FIG. 18, because such rays 122 are generally not responsible for defining the light pattern such as Type 3 or Type 5. Two manners for promoting this goal is by maximizing overall height of the lens 64 from the photometric center 110 and by reducing the radial extent of the central portion such as central portion 124 of the lens 100 as shown in FIG. 18. The non-symmetrical half 170 of lens 150 is further designed to minimize light being cast in the undesired direction U, preferably casting the light either laterally to directions D and U or towards direction D.

Figure 23:
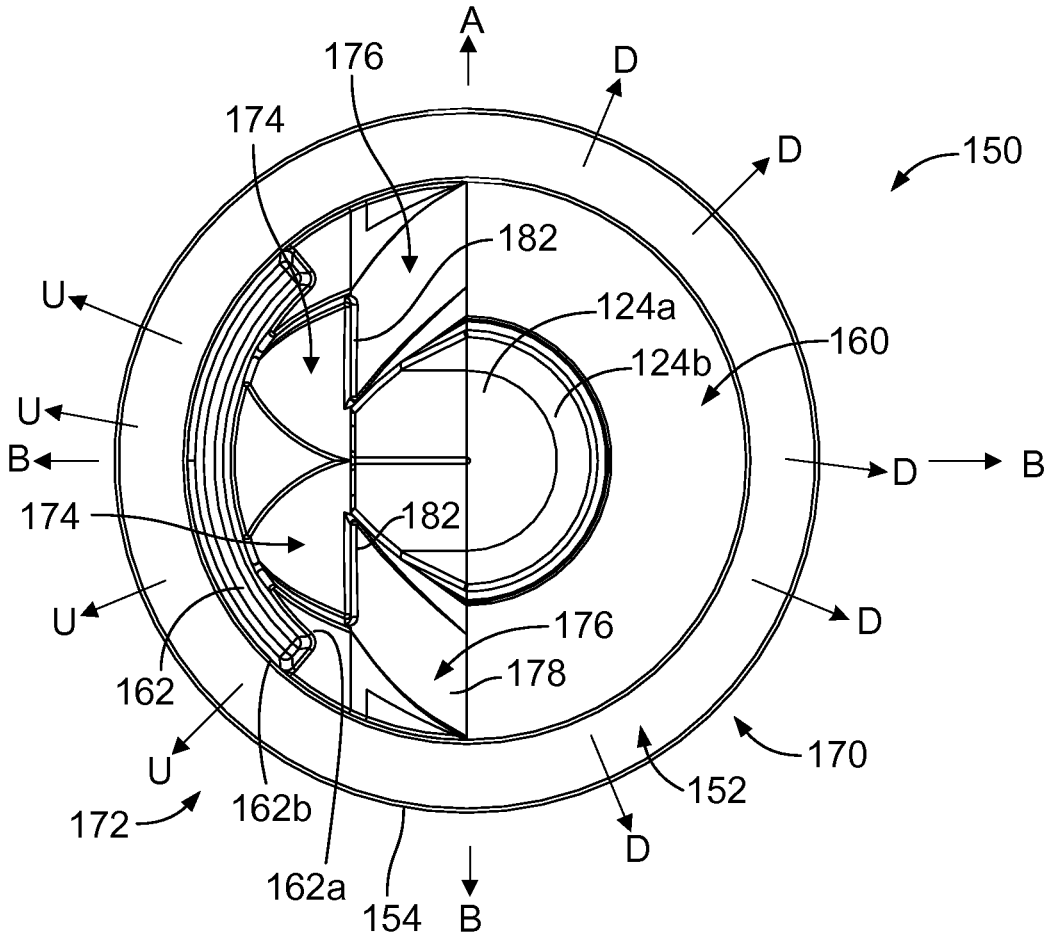
FIG. 23 is a top plan view of the optic lens of FIG. 19.

The non-symmetrical half 170 may be viewed as being in three portions, the shield 162, a "wing" section 174, and a "boat" section 176. Each section 162, 174, 176 is symmetrical about an axis B (FIG. 23). The boat section 176 has outer surfaces 178 that are angled radially downwardly at a much greater angle (from vertical axis C, FIG. 22) than the angle of medial portion 128 (FIG. 22); in addition, the outer surfaces 178 angle inwardly (toward axis B, FIG. 23) much more sharply than the semi-circular shape of medial portion 128 (FIG. 23). Thus, rays 122 from the photometric center 110 (FIG. 22) are emitted from the boat outer surfaces 178, and the rays 122 therethrough are refracted both towards the axis C (FIG. 22) and towards axis A (FIG. 23). The boat section 176 also has inner surfaces 180; as can be seen in FIG. 23, the inner surfaces 180 extend radially to a shorter extent than surfaces 124*a*, 124*b*, which reduces the number of rays 122 (amount of light) that pass orthogonally (substantially in the direction of axis C) from the lens 150. Additionally, the inner surfaces 180 are somewhat V-shaped across the axis B and are substantially flat; in this manner, the inner surfaces 180 tend to refract light in the lateral direction of axis A, thereby minimizing or reducing the number of rays 122 through the inner surfaces 180 that are directed toward the undesirable direction U.

The wing section 174 is somewhat similar to the boat section 176, as can be seen in FIG. 23, so that rays 122 are refracted towards the axes A and C, towards desired direction D, and away from undesired direction U. The wing section 174 has shield surfaces 182 which receive rays 122 from the other sections, principally from the boat section 176, and reflect (or disperse) the light forward in the desired direction D or in the direction of axis C. The wing section 174 has outer surfaces 184 and inner surfaces 186 that each refract the light towards the axes A and C. A more detailed viewing of the light passing through the lens 150 is apparent through a comparison of the lens 150 with lens 600, discussed below.

The light emitting portion 160 is orientation specific. Accordingly, each of the lenses 150 may be individually adjusted for the light cast therefrom. As the lenses 150 are not heat-staked or otherwise fixedly mounted with the light element assembly 18 or the cover plate 70, a technician can adjust the position of the lenses 150 after assembly. $L_2$Optics LTD, United Kingdom, utilizes an "adhesive pad" to retain lenses over the LEDs; again, this does not allow a user to change the position of the lens unless it is first released (separated) from the adhesive pad.

It should be noted that, as the lantern 10 has been discussed as scalable, lenses 64 with different light patterns may be used in a single lantern 10, or lenses with different lighting effects (such as diffusion, or colors, or level of opacity) may be retrofitted, replaced, or combined in a single lantern 10.

As discussed in the background, LED-based lanterns tend to generate a significant amount of heat on the back side of the LED 44, that is, between the LED 44 and its PCB 50. A number of features described herein are designed to accommodate heat dissipation, such as the foil layer on the back of the PCB 50 and the use of thermally conductive material for the PCB 50 and the fixture plate 30.

Also discussed in the background is the prior art approach of building an internal unit that is installed within a shell, the internal unit including a heat sink. The internal unit may include approximately eight pounds of aluminum for the heat sink, and this unit is what is handled by a technician in assembling or installing the lantern. The prior art has an insulating air space between the heat sink and the outer shell of the lantern.

Figure 24:
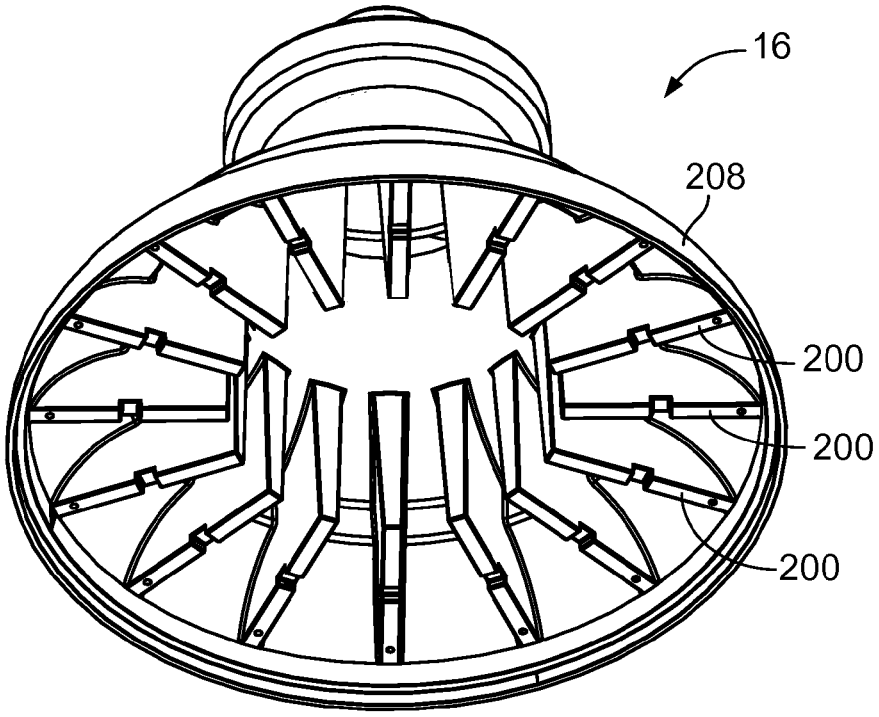
FIG. 24 is a perspective view of the canopy of FIG. 2.
Figure 25:
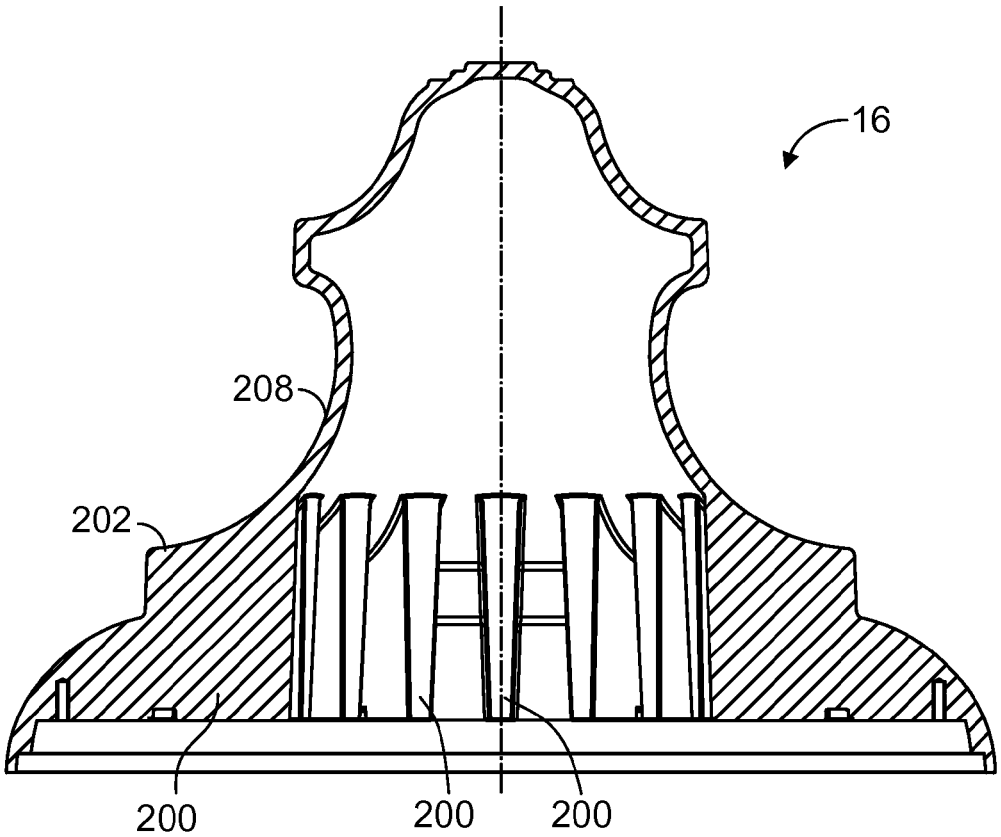
FIG. 25 is a cross-sectional view of the canopy of FIG. 24.

Turning to FIGS. 24 and 25, the canopy 16 is illustrated. In contrast to the prior art, the present canopy 16 includes integrally formed heat sink fans 200. The fixture plate 30 with the lighting element assemblies 18 thereon is mounted directly to the fans 200, eliminating the insulating air of the prior art lanterns. The fans 200 are integral with the canopy 16 (specifically, a canopy housing 208) so that heat passing from the LEDs 44, to the PCB 50, to the fixture plate 30, to the fans 200 easily passes to the exterior surface 202 of the canopy housing 208.

As discussed above in the background, a prior art lantern typically has the LEDs mounted directly to the heat sink. Accordingly, alteration of the LEDs is usually less costly when the entire unit is simply thrown away, as the labor required to remove the LEDs and associated wiring and then re-mounting a new LED assembly and circuit is more costly than the materials waste. For forms of the present invention, as discussed above, the only portion that need be replaced is the comparatively inexpensive lighting element assembly 18, which often carries only a subset of the total LEDs 44.

Figure 26:
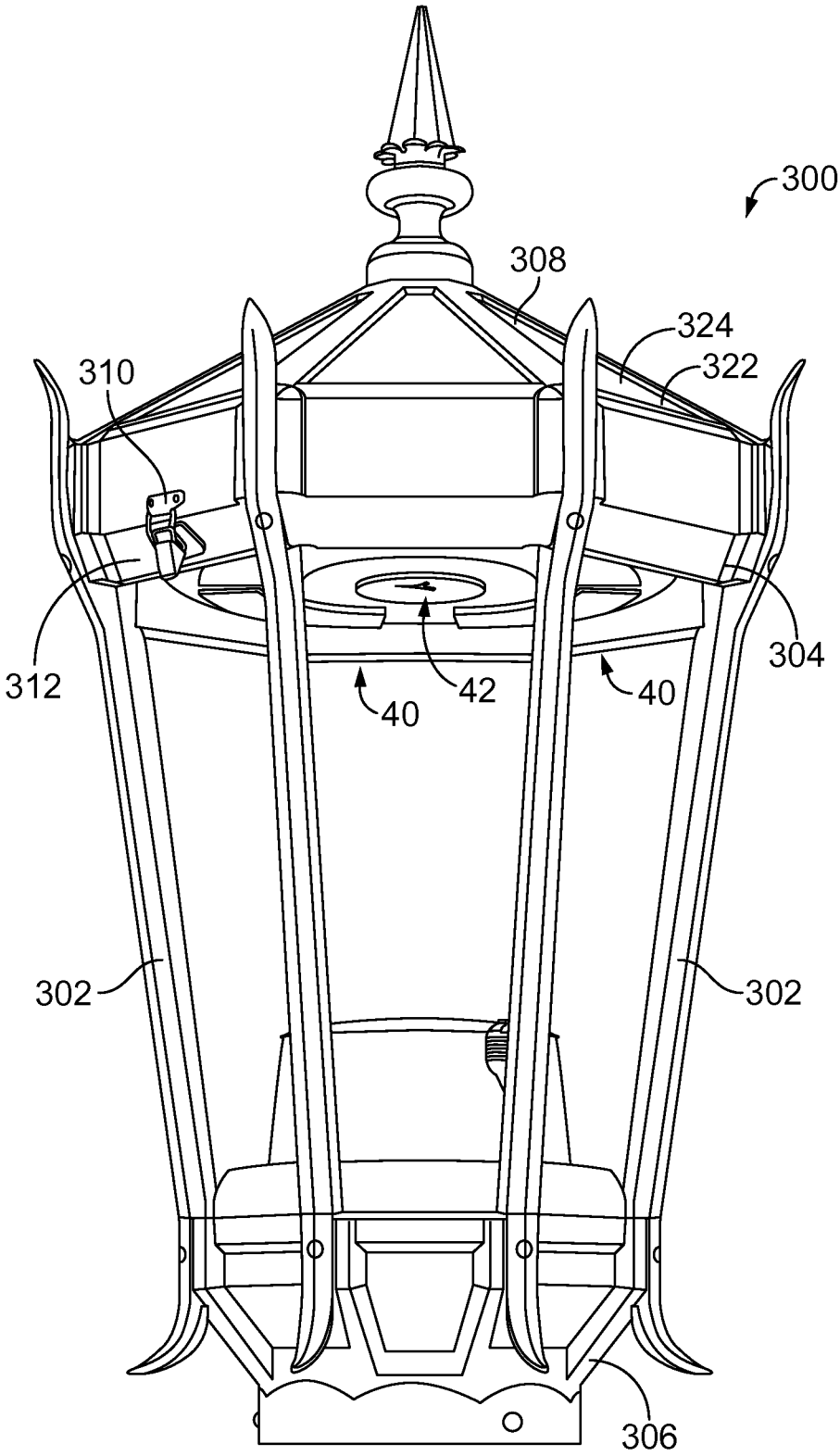
FIG. 26 is an alternative form of a lantern having an alternative form of a canopy.
Figure 27:
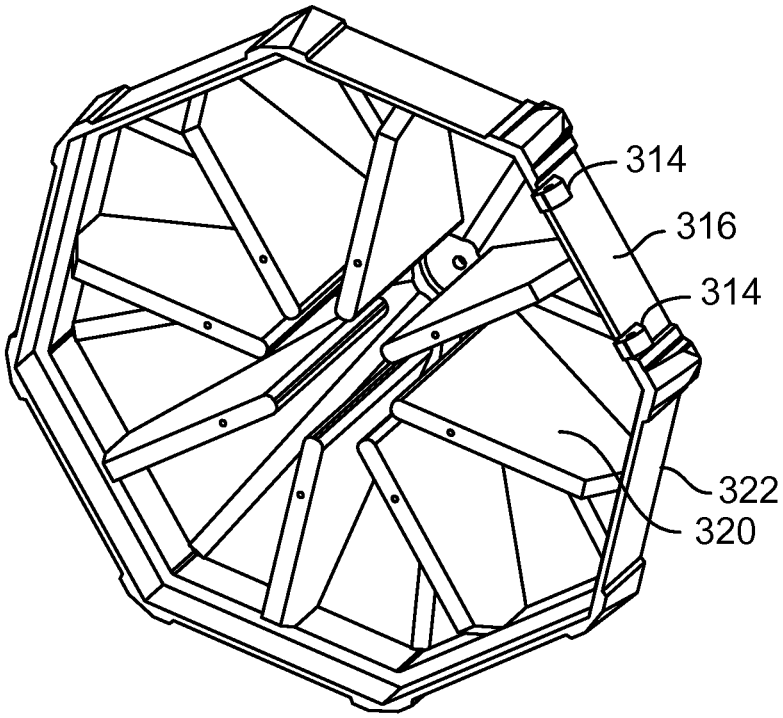
FIG. 27 is a perspective view of the canopy of FIG. 26.

FIG. 26 shows an alternative form of the lantern 10 as lantern 300. In contrast to the lantern 10, lantern 300 includes support arms 302 for connecting a canopy support 304 to a base 306. The canopy support 304 supports and connects a canopy 308 to the rest of the lantern 300. In FIG. 26, a latch 310 is shown for connecting one side 312 of the canopy 308 to the canopy support 304, while FIG. 27 shows hinge connections 314 for hingedly connecting a second side 316 of the canopy 308 to the canopy support 304. In the illustrated form, the lantern 300 includes four individual arc light element assemblies 40 and a single circular light element assembly 42. Like the canopy 16, the canopy 308 includes fans 320 integrally formed with an outer housing 322, which has an outer surface 324. Like the lantern 10, the lighting element assemblies 40, 42 pass heat through their PCBs 50, to the fixture plate 30, to the fans 320, and, ultimately, to the outer surface 324 for dissipation therefrom.

Figure 28:
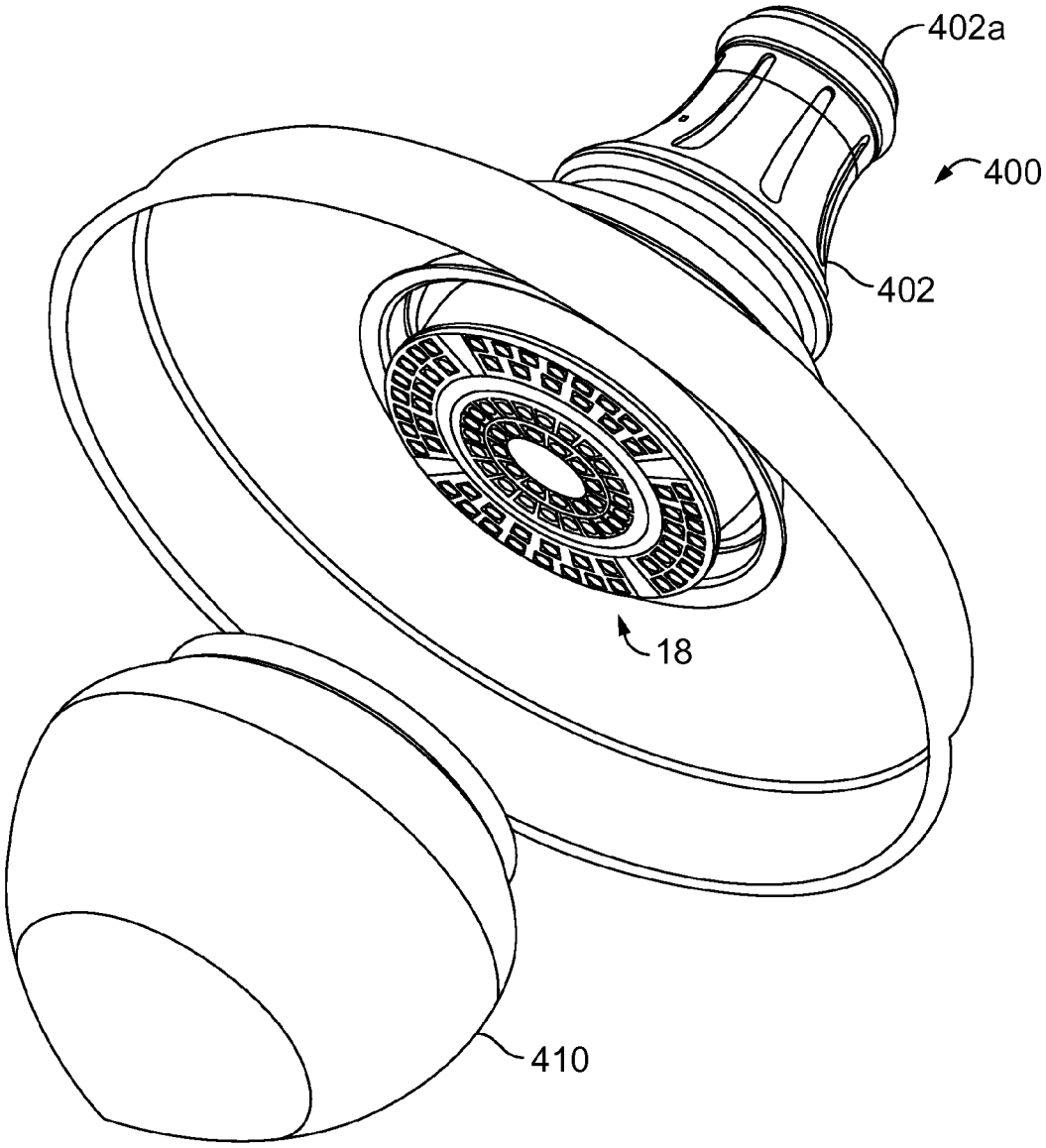
FIG. 28 is a second alternative form of a lantern having an alternative form of a canopy wherein the lantern depends from and the canopy is mounted with a support.

FIG. 28 shows a further alternative form of the lantern 10 as a pendant lantern 400. The lantern 400 includes a canopy 402 that is securable at a top point 402*a* thereof to a support (not shown). The canopy 402 includes fans (not shown) formed integrally therewith for each dissipation, the illustrated lighting elements 18 being secured directly or operatively with the fans for heat dissipation therethrough. A light cover or globe 410, such as a diffuser, is illustrated as would be mounted to an outer hood 420 portion of the canopy 402.

The above discussion regarding lenses 64 described two embodiments of lenses 64 as lens 100 and lens 150 as producing Type 5 and Type 3 lighting patterns, respectively. The lenses 100 and 150 are maintained or secured by the cover plates 70, and generally utilized optical gel. Alternative forms of lenses 64 are described below.

Turning to FIGS. 29-32, lenses 500 are mechanically securable to a PCB 50 via a securement device 510. In the present forms, the securement 510 is ring-shaped and includes board-mounting features 512.

Figure 29:
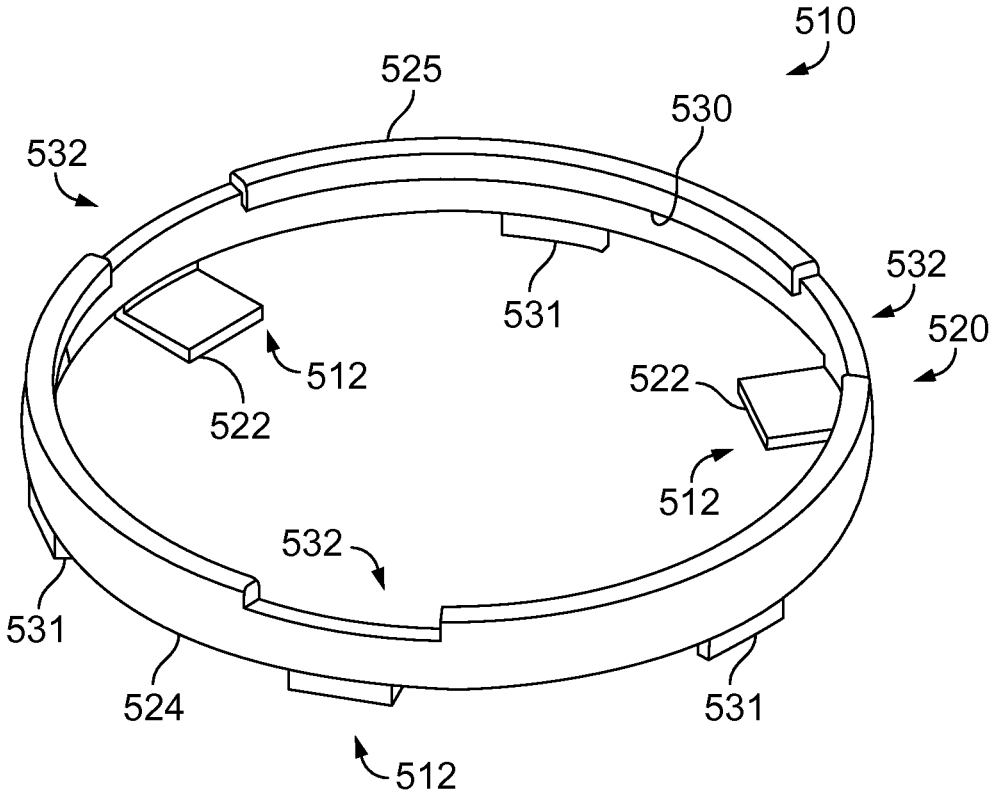
FIG. 29 is a perspective view of a securement for retaining and mounting a lens within the assemblies described herein.
Figure 30:
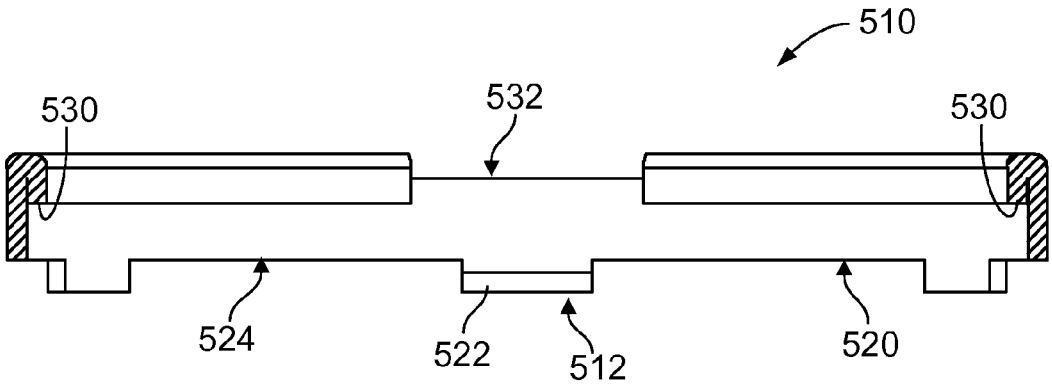
FIG. 30 is a cross-sectional view of the securement of FIG. 29 showing a shoulder for retaining the lens therein.
Figure 31:
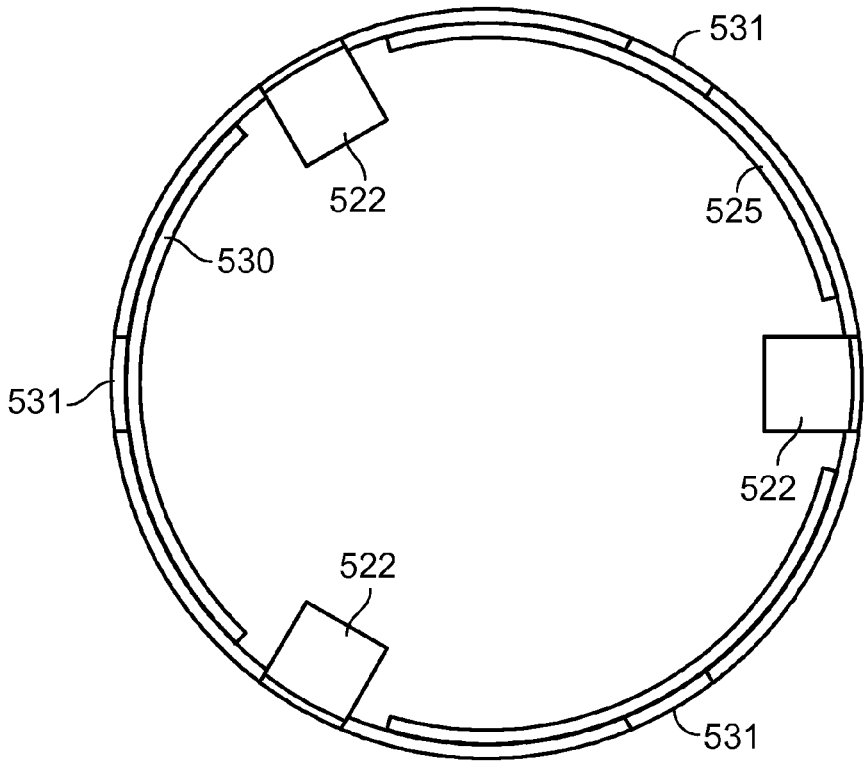
FIG. 31 is a bottom plan view of the securement of FIG. 29 showing a plurality of tabs for a solder joint with a PCB.

Turning specifically to FIGS. 29-31, a first embodiment of a securement 510 is shown as ring 520. The board-mounting features 512 are in the form of tabs 522 extending axially downward with a first component and extending outward or inward with a second component. In the preferred form, the ring 520 is formed of metal and, more preferably, of tin plated copper. To assembly the ring 520 with the PCB 50, solder pads (not shown) are provided on the PCB 50 surrounding or proximate to the connection points for the LEDs 44. The metal rings 520 and LEDs 44 are placed on their respective connection points (solder pads), and the solder reflow step for connecting the LEDs 44 also joins the tabs 522 with the PCB 50.

Figure 32:
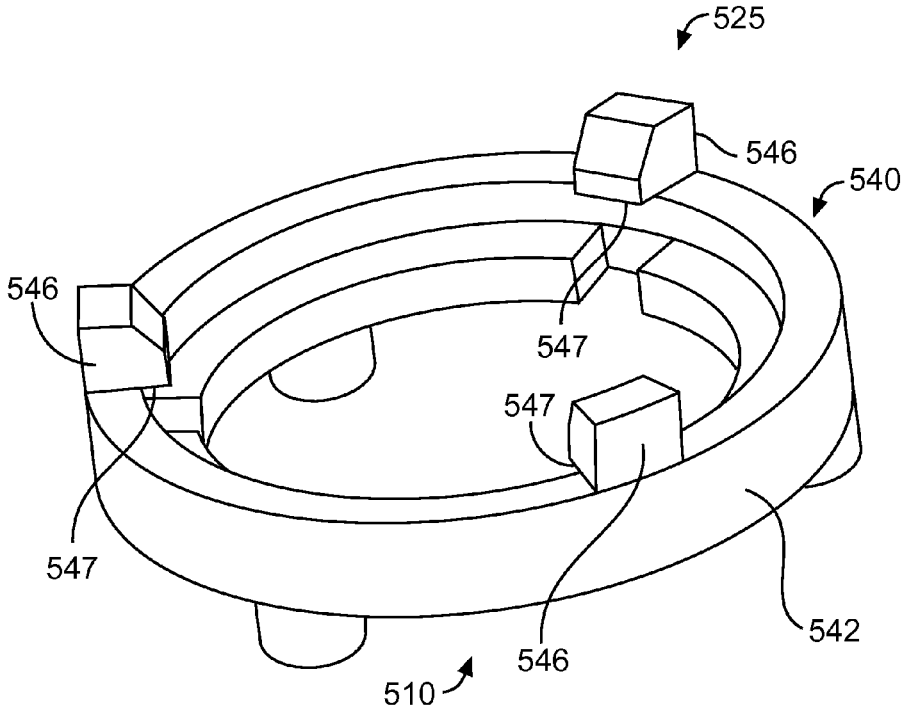
FIG. 32 is a perspective view of second embodiment of a securement for retaining and mounting a lens within the assemblies described herein.

The securements 510 serve to mount and position the lenses 500 on the PCB 50. Turning to FIGS. 31 and 32, it can be seen that the body 524 includes lens-retaining features 525 a lip or shoulder 530 formed thereon and facing towards the PCB 50 when mounted therewith. As will be discussed below, the lenses 500 snap into the ring 520 by snapping into the shoulder 530. Additionally, the ring 520 includes tabs 531 extending axially downwardly that assist in positioning the ring 520 on the PCB 50. In the present form, the shoulder 530 is discontinuous having a plurality of gaps 532; in some forms, the gaps 532 may be used to receive securing structure 550 (FIG. 33, e.g.) on the lens 500 received within the ring 520, the lens 500 then being rotated so that the structure 540 is received underneath the shoulder 530.

In the present form, three stand-off tabs 531 and three solder tabs 522 are provided, though the number may be varied. In some forms, the stand-off tabs 531 may alternatively be radially inwardly extending from the body 524 so as to restrict the rotation of the lens 500.

In another alternative, a securement 510 may be provided in the form of ring 540, illustrated in FIG. 32. The ring 540 has a generally annular body 542 with board-mounting features 512 in the form of posts 544. In the preferred form, the ring 540 is formed of thermoplastic and, thus, the posts 544 may be inserted into openings of the PCB 50 and heat-staked thereto. The ring 540 includes lens-retaining features 525 in the form of retaining blocks 546 having downwardly-facing shoulders 547 formed thereon. An inner surface 546*a* of the block 546 is beveled or chamfered for assisting in receiving the lens securing structure 550 (FIG. 33. e.g.) therein. The ring 540 further includes arcuate segments 549 defining retention gaps 548 for receiving the lens securing structure 550 therewithin to prevent rotation of the lens 550 once received by the ring 540.

Figure 33:
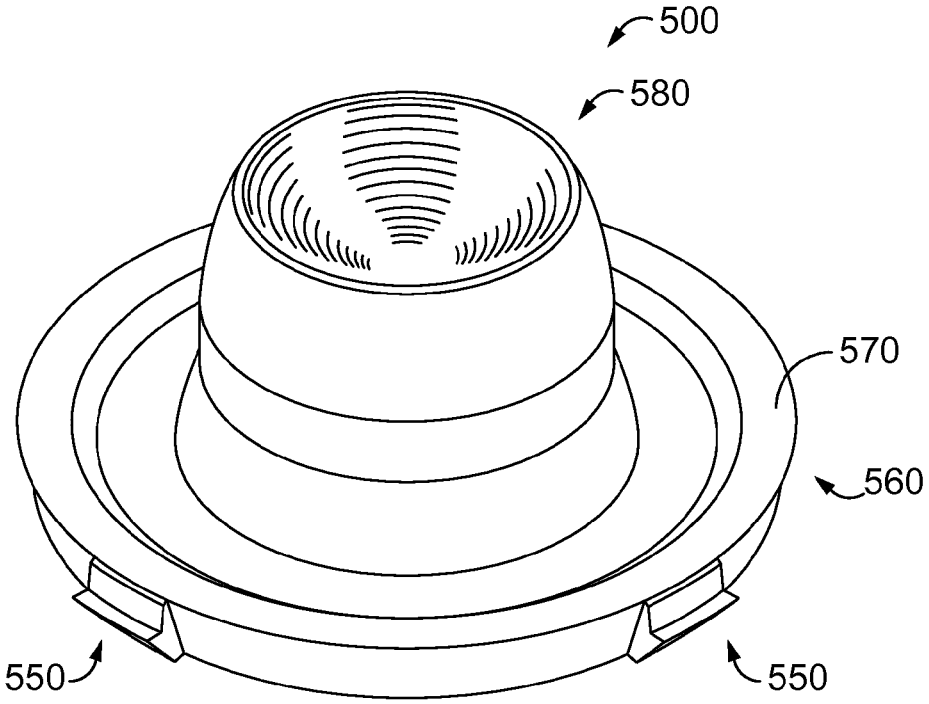
FIG. 33 is a perspective view of a second embodiment of an Optic lens for providing a Type 5 lighting pattern.
Figure 36:
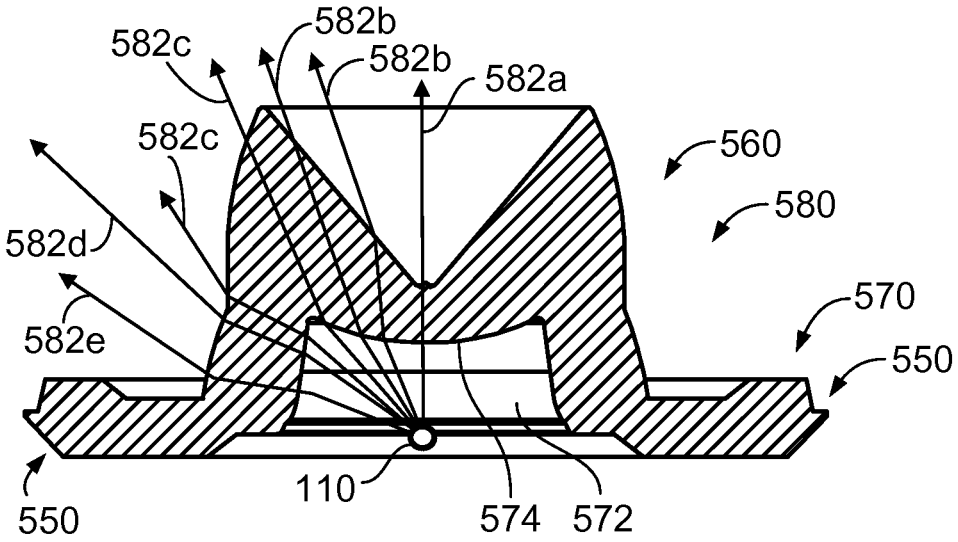
FIG. 36 is a cross-sectional view of the optic lens of FIG. 33 showing lines representing paths of light rays for a light ray emission pattern from an LED through the optic lens.
Figure 37:
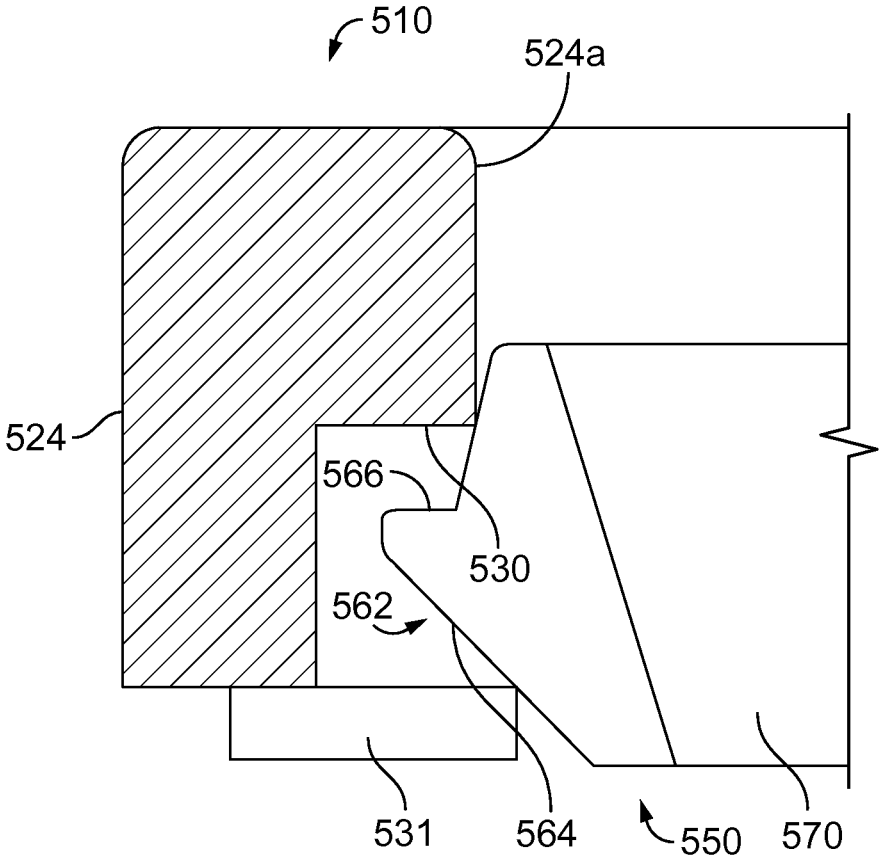
FIG. 37 is a partial fragmentary cross-sectional view of the optic lens of FIG. 33 and the securement of FIG. 30 showing the securing structure of the lens cooperating with the securement to retain the lens therewith.
Figure 38:
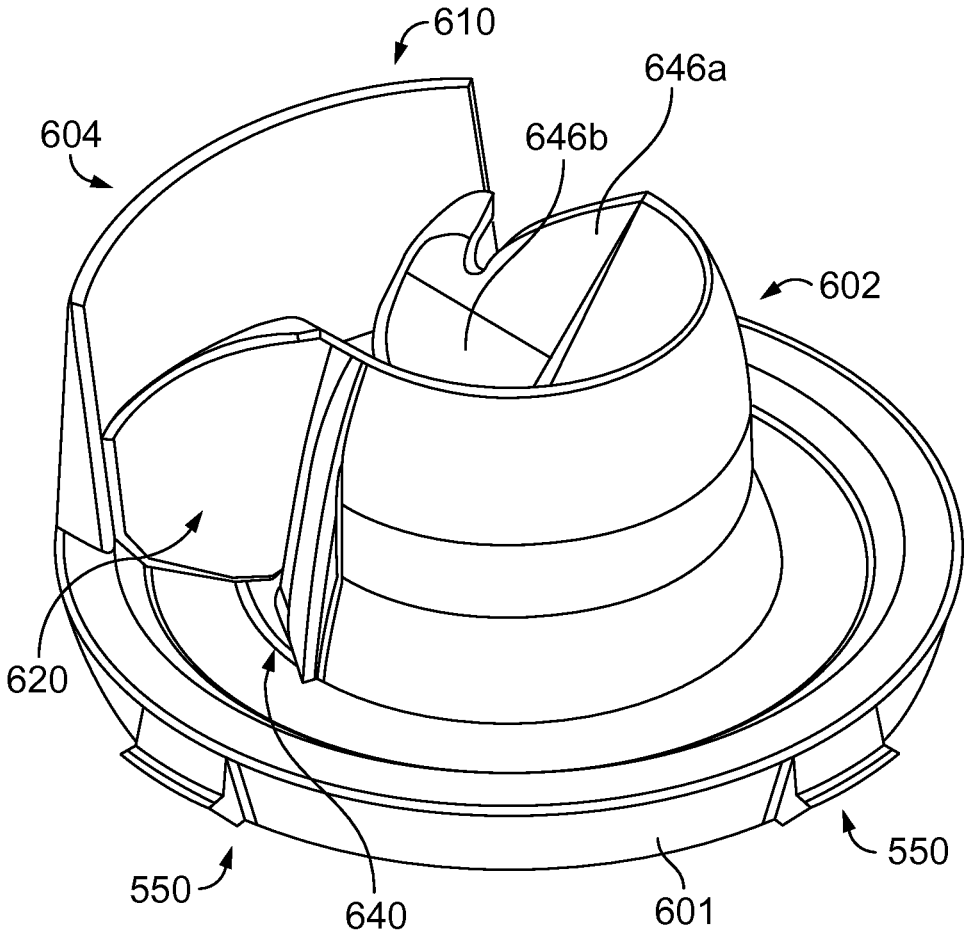
FIG. 38 is a perspective view of a second embodiment of an optic lens for providing a Type 3 lighting pattern.

Turning to FIG. 33, et seq., lenses 500 are provided with the above-mentioned lens securing structure 550. A representative lens 500 for use with the securements 510 is illustrated in FIGS. 33-36 as a lens 560 producing a Type 5 lighting pattern. As can be seen, lens 560 has securing structure 550 in the form of a plurality of barbs 562 having a leading chamfer 564 for assisting in snapping the lens 560 into the securement 510 and a trailing shoulder 566 that is generally horizontal or parallel with the PCB 50 when secured therewith. As can be seen in FIG. 37, force applied to the lens 560 to direct the lens 560 within the securement 510 causes a combination of compression on the lens 560 and expansion of the securement 510 as the chamfer 564 is driven against the interior edge 524*a* of the body 524. Once the chamfer 564 clears the body shoulder 530, each of the lens 560 and securement 510 are able to return to their natural state. The shoulders 530 and 566 then cooperate to retain the lens 560 within the securement 510.

Figure 34:
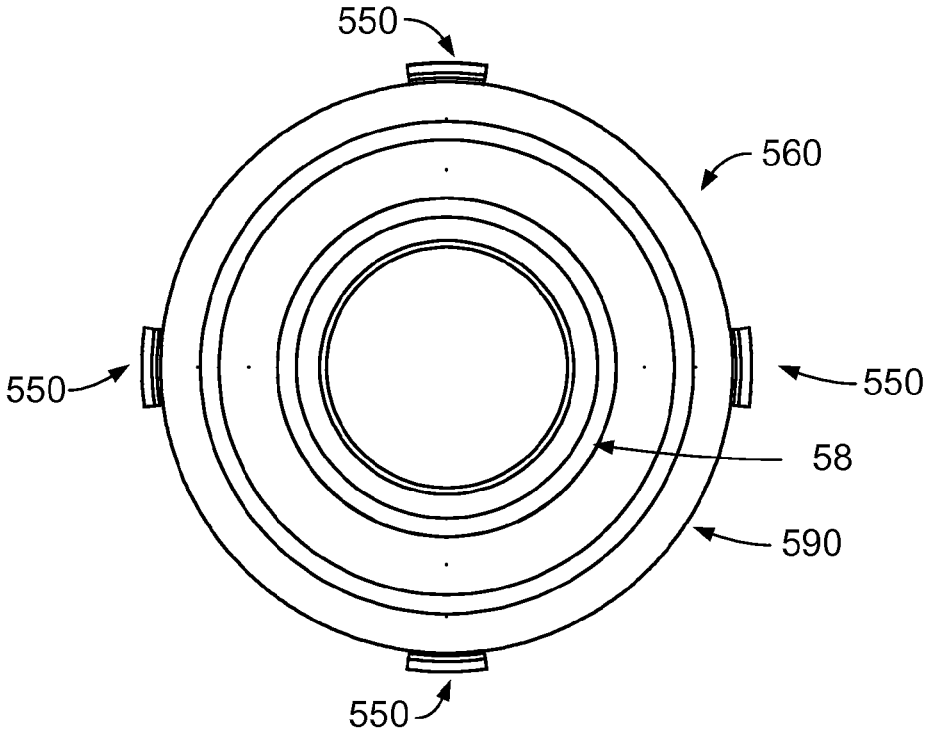
FIG. 34 is a top plan view of the optic lens of FIG. 33 showing securing structure for cooperating with a securement.
Figure 35:
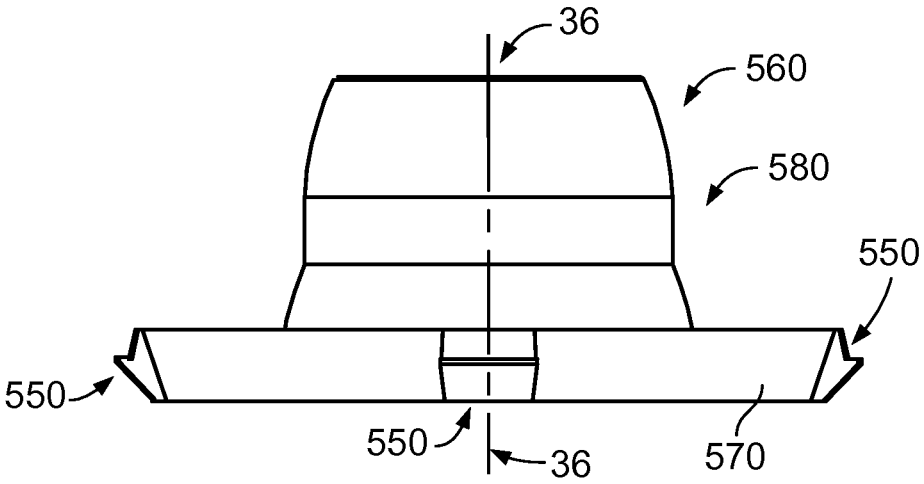
FIG. 35 is a side elevational view of the optic lens of FIG. 33.

It should also be noted that the geometry of the lens 560 varies from that of lens 500, as can be seen by comparing FIGS. 33-35 with FIGS. 14-18. The lens 560 has a base 570 from which the securing structure 550 radially extends. The base 570 includes a cavity 572 for receiving the LED 44 therein, and the photometric center 110 of the LED 44 is shown in FIG. 36. The top 574 of the cavity 572 is convex, in contrast to that of the lens 500 (FIG. 18).

Rays 122 pass from the LED 44, generally from the photometric center 110, through the lens 560 and, predominantly, through a central emission portion 580 thereof, as illustrated in FIG. 36. As discussed above, rays 582 are refracted towards normal when entering the lens 560 and away from normal when leaving the lens 560. Ray 582*a* exits straight from the photometric center 110 through the central emission portion 580 along axis C and through a center conical portion 584 of the central emission portion 580. Light ray 582*b*, radially outward from ray 582*a*, also passes through the center conical portion 548. Light rays 582*c* pass through a first outer section 586 of the central emission portion 580, while light rays 582*d* and 582*e* pass through a second outer section 588 of the central emission portion 580. As can be seen, the lens 560 thus casts the light rays 582 outwardly to form a halo pattern, with an illuminated center of lower intensity, a plurality of the lenses 560 being arrayed to produce the Type 5 lighting pattern.

Figure 43:
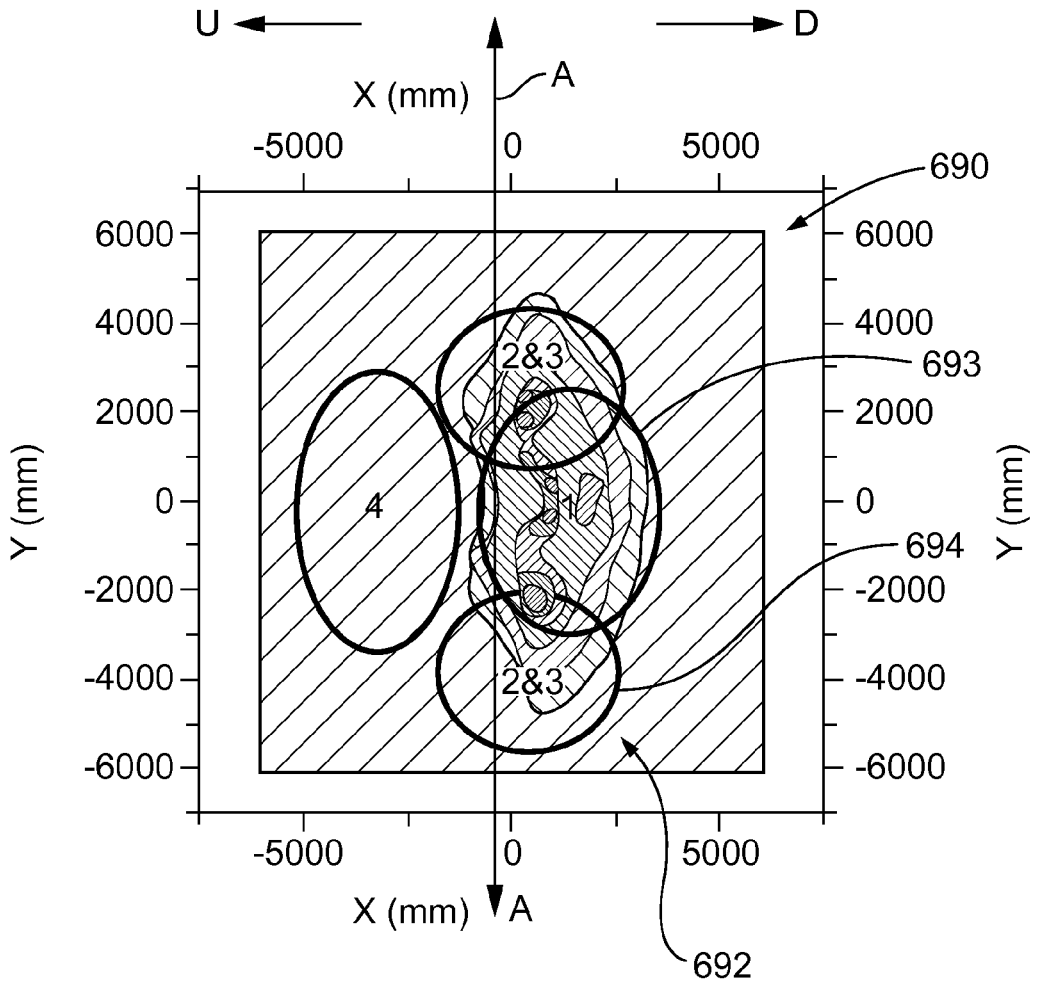
FIG. 43 is a plot of light emitted from the optic lens of FIG. 38.

Turning to FIGS. 38-42, a lens 500 for securing with a securement 510 is illustrated as a lens 600 that produces a Type 3 lighting pattern, as best viewed in FIG. 43. As can be seen, the lens 600 includes the securing structure 550 in a substantially identical manner as the securing structure 550 of lens 560 and, thus, the lens 600 is secured with and retained the securement 510 as illustrated in FIG. 37. That is, the securing structure 550 of the lens 600 is the form of a plurality of barbs 562 having a leading chamfer 564 (FIG. 40) for assisting in snapping the lens 560 into the securement 510 and a trailing shoulder 566 (FIG. 40) that is generally horizontal or parallel with the PCB 50 when secured therewith, the chamfer 564 and shoulder 566 engaging and cooperating with the interior edge 524*a* of the body 524 to snap the lens 600 within the securement 510, each of the lens 560 and securement 510 are able to return to their natural state once the chamfer 564 clears the body shoulder 530.

Like lens 150, lens 600 includes a base 601, a semi-symmetrical portion 602 and a non-symmetrical portion 604. The semi-symmetrical portion 602 is substantially identical to the central emission portion 580 of lens 560, discussed above, and forms approximately half of the lens 600, other than the base 601. The non-symmetrical portion 604 includes a shield 610 similar to the shield 162 of lens 150, a wing section 620 similar to the wing section 174 of lens 150, and a boat section 640 similar to the boat section 176 of the lens 150.

Figure 39:
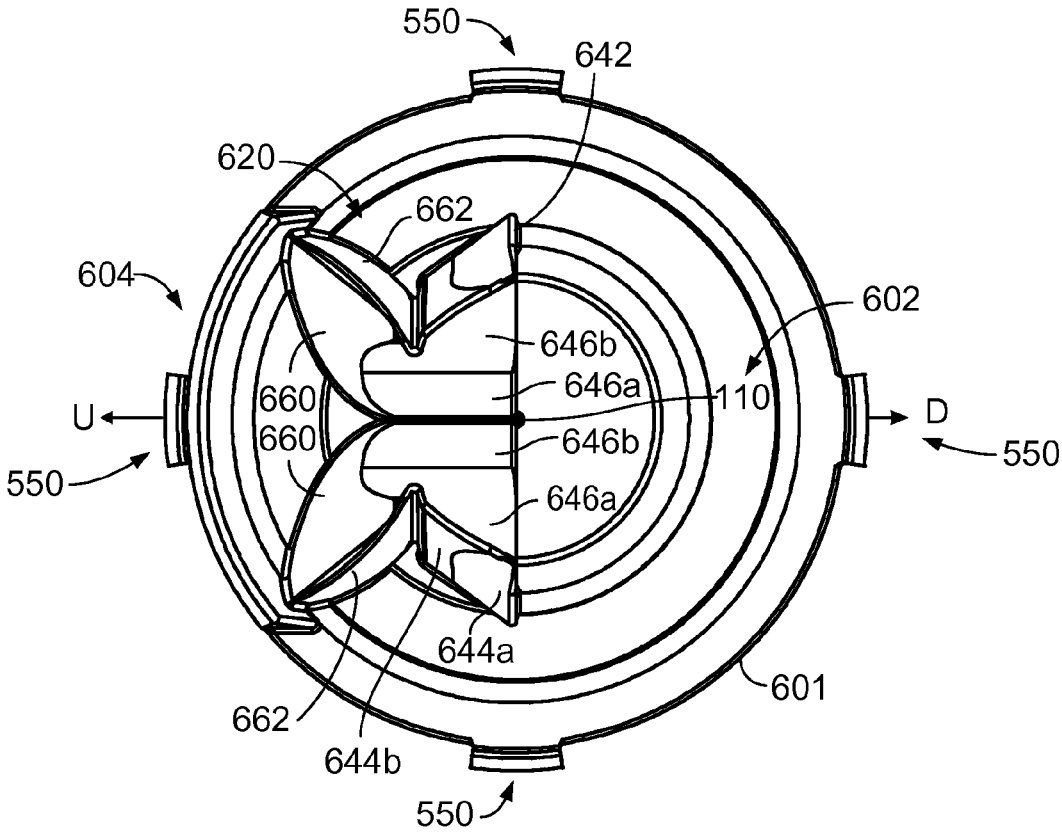
FIG. 39 is a top plan view of the optic lens of FIG. 38.
Figure 40:
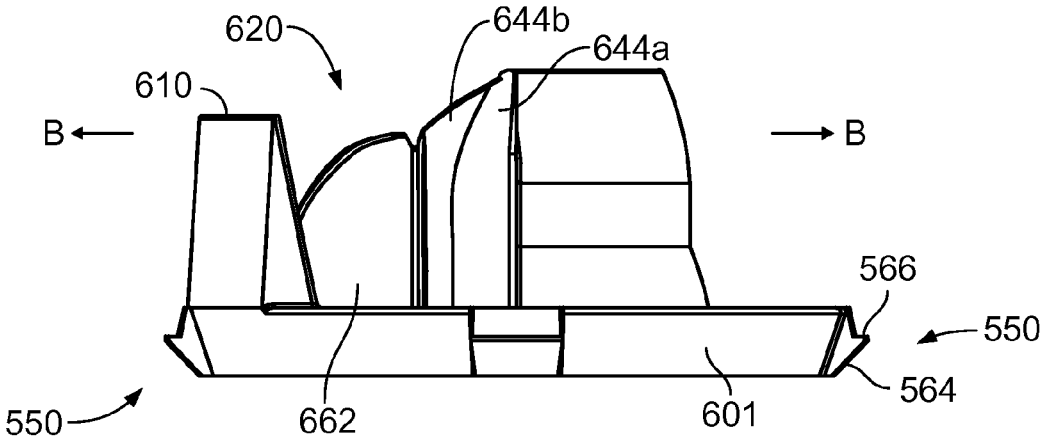
FIG. 40 is a side elevational view of the optic lens of FIG. 38.
Figure 41:
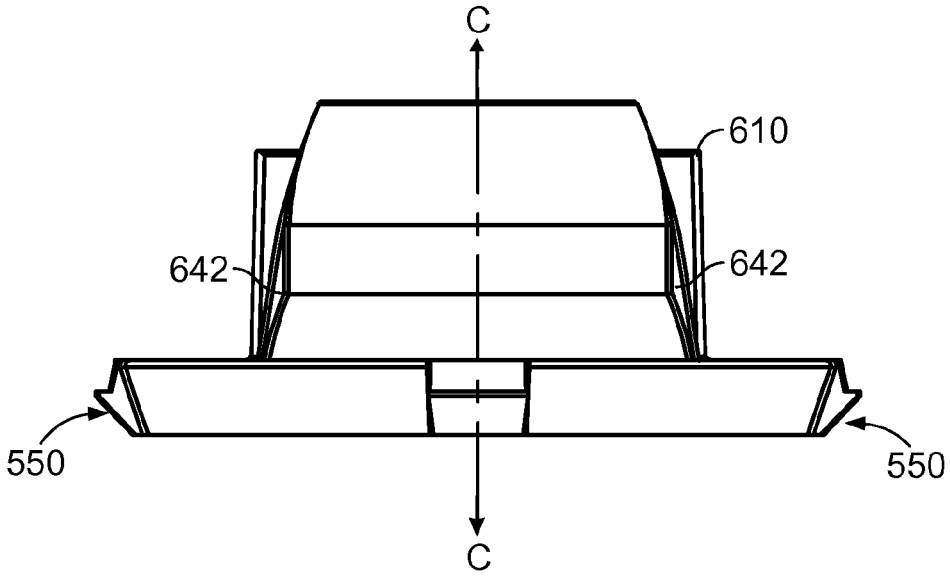
FIG. 41 is a front elevational view of the optic lens of FIG. 38.
Figure 42:
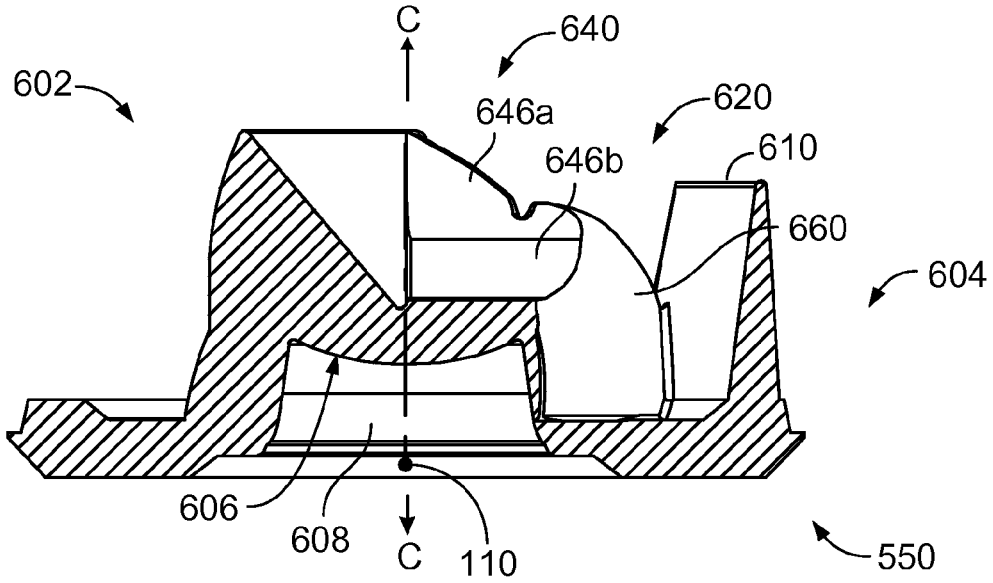
FIG. 42 is a cross-sectional view of the optic lens of FIG. 38.

In the same pursuit of lens 150, lens 600 seeks to cast light from the non-symmetrical portion 604 towards the desired direction D and away from the undesired direction U (FIG. 39). More specifically, the lens 600 redirects light from the undesired direction U towards the axes A and C, as well as towards the desired direction D. As the semi-symmetrical portion 602 allows light to pass in the same manner as discussed above for lens 560, it is not repeated here in detail.

The shield 610 is preferably frosted so as to disperse light and/or to reflect any light towards desired direction D and/or axis C.

The boat section 640 extends slightly beyond, radially, a portion of the semi-symmetrical portion 602. In this manner, small shield surfaces 642 are provided for interfering with errant light rays that may be emitted from the semi-symmetrical portion 602. These surfaces 642 are principally provided, though, so that other surfaces of the boat section 640 may extend to a greater degree.

More specifically, the boat section 640 includes forward and rearward 644*a* and 644*b* and upper and lower inner surfaces 646*a* and 646*b*. As a theoretical matter, light rays are emitted from the photometric center 110 of the LED 44, shown in FIGS. 39 and 42. As discussed above, the lens 600 refracts the light rays entering towards normal and refracts the light rays exiting away from the normal. The convex surface 606 on the interior of a cavity 608 provided for the LED 44 located therein tends to focus more rays from the photometric center 110 through the general center of the lens 600. As can be visualized, a portion of the rays from the LED 44 through the non-symmetrical portion 604 are emitted close to the axis C (see FIGS. 39 and 42) and, thus, pass through the inner surfaces 646*a* and 646*b* of the boat section 640. As an example, light is radially emitted from the photometric center 110 and enter the lens 600 at the convex surface 606, which would refract the light towards the normal which is also towards axis C (FIG. 2); as such light exits the lens 600, it is refracted away from the normal at the inner surfaces 646*a*, 646*b*, which are severely angled so that the light is directed laterally towards axis A (as well as axis C).

The same principal guides light passing through the forward and rearward surfaces 644*a*, 644*b* of the boat section 640. That is, light emitted from the photometric center 110 (see FIG. 39) to be refracted away from the normal when exiting; as can be seen in FIG. 39, the forward and rearward surfaces 644*a*, 644*b* are angled with respect to the photometric center 110 such that the radial distance of a point on the forward and rearward surfaces 644*a*, 644*b* increases from the rearward-most area to the forward-most (rearward being in the undesirable direction U). Thus, normal direction is angled rearwardly, and the light emitted from these surfaces (refracted away from the normal) is bent towards the axis A.

A comparatively small portion of light reaches inner and outer surfaces 660, 662 of the wing section 620. Generally speaking, light emitted through the wing section 620 is at a severe angle from the normal. The outer surfaces 662 are curved to produce severe angles with respect to normal for light emitting from the outer surfaces 662, the result being that light emitted therefrom is bent towards the lateral direction of axis A and the vertical direction of axis C. The inner surfaces 660 attempt to generally redirect light towards the axis C; however, comparatively little light reaches these surfaces, and a significant portion is simply allowed to be dispersed by the shield 610.

Turning to FIG. 43, a plot 690 of light emitted from the lens 600 is illustrated. The lens 600 positioned 1000 mm from a surface produces the plot 690. The outer dark gray region 692 indicates absence or minimal light; lighter areas progressing inwardly as 693 correlate to greater intensity of light; finally, dark regions 694 within the lighter areas correspond with the greatest intensity of light on the surface. The axis A corresponds to the axis A of the lens 600 shown in FIG. 39.

As can be seen, a region 4 corresponds to light received generally from the shield 610. Thus, it can be seen that the shield 610 is responsible for very little or no light reaching the surface. A region 1 corresponds to light received from the semi-symmetrical portion 602. The region labeled 2 & 3 indicates light received from the wing section 620 and the boat section 640. As can be seen, light from the semi-symmetrical portion 602 overlaps with light received from the wing section 620 and the boat section 640, the latter of which heavily overlap as well.

While the invention has been described with respect to specific examples including presently preferred modes of carrying out the invention, those skilled in the art will appreciate that there are numerous variations and permutations of the above described systems and techniques that fall within the spirit and scope of the invention as set forth in the appended claims.

What is claimed is:

1. A lighting device comprising:

a canopy including:

an outer surface externally exposed to atmosphere for heat dissipation; and a heat sink adapted to transfer heat to the outer surface;

a lighting element;

a securement device adapted to couple with the lighting element including:

a ring defining a radial direction and an axial direction extending through the ring;

a plurality of tabs coupled to an inner circumferential edge of the ring and having a first component extending in the axial direction and a second component extending in the radial direction; and a lens retaining feature extending arcuately within the ring and adapted to abut a shoulder of the lighting element; and a printed circuit board (PCB) soldered to the second component, wherein the canopy is adapted to couple the securement device to the heat sink such that the heat sink transfers heat from the lighting element.

2. The lighting device of claim 1, wherein the lighting element includes a light emitting diode (LED).

3. The lighting device of claim 1, further comprising a fixture plate disposed between and in contact with both the PCB and the heat sink.

4. The lighting device of claim 1, wherein the printed circuit board (PCB) is electrically coupled to the second component.

5. A lighting device comprising:

a canopy including:

an outer surface externally exposed to atmosphere for heat dissipation; and a heat sink adapted to transfer heat to the outer surface;

a lighting element; and a securement device adapted to couple with the lighting element and including:

a ring;

a retaining block disposed on a periphery of the ring and including a downwardly-facing retaining block shoulder; and arcuate segments disposed radially inward from the ring and defining a retention gap between at least two of the arcuate segments, the retention gap adapted to receive the lighting element and radially retain the lighting element therein, wherein the canopy is adapted to couple the securement device to the heat sink such that the heat sink transfers heat from the lighting element, wherein the lighting element further includes a plurality of barbs having a lighting element shoulder and a chamfer extending from the lighting element shoulder, the chamfer having a chamfer outer diameter and a chamfer inner diameter, and wherein the securement device includes an interior edge having an edge inner diameter less than the chamfer inner diameter.

* * * * *